US012446705B2

(12) United States Patent
Sopher

(10) Patent No.: US 12,446,705 B2
(45) **Date of Patent: *Oct. 21, 2025**

(54) BEDDING SYSTEMS

(71) Applicant: The QuickZip Sheet Company, Inc, Denver, CO (US)

(72) Inventor: Elizabeth Sopher, Denver, CO (US)

(73) Assignee: THE QUICKZIP SHEET COMPANY, INC., Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/734,614

(22) Filed: Jun. 5, 2024

(65) Prior Publication Data

US 2025/0000270 A1 Jan. 2, 2025

Related U.S. Application Data

(63) Continuation of application No. 17/443,488, filed on Jul. 27, 2021, now Pat. No. 12,004,653, which is a continuation-in-part of application No. 16/706,756, filed on Dec. 8, 2019, now Pat. No. 11,071,395.

(60) Provisional application No. 62/777,179, filed on Dec. 9, 2018.

(51) Int. Cl.

| | |
|---|---|
| ***A47C 21/02*** | (2006.01) |
| ***A47G 9/02*** | (2006.01) |
| ***A47G 9/04*** | (2006.01) |

(52) U.S. Cl.

CPC ..... *A47C 21/022* (2013.01); *A47G 9/0238* (2013.01); *A47G 9/04* (2013.01)

(58) Field of Classification Search

CPC .. A47C 21/022; A47C 21/028; A47G 9/0238; A47G 9/04

See application file for complete search history.

(56) References Cited

U.S. PATENT DOCUMENTS

| | | | |
|---|---|---|---|
| 2,154,910 | A | 4/1939 | Magaril |
| 2,400,731 | A | 5/1946 | Armstrong |
| 2,630,588 | A | 3/1953 | Levin |
| 2,789,292 | A | 4/1957 | Budinquest |
| 2,907,055 | A | 10/1959 | Berman |
| 2,973,526 | A | 3/1961 | Wetzler |
| 3,027,573 | A | 4/1962 | Bell, Jr. |

(Continued)

FOREIGN PATENT DOCUMENTS

| | | |
|---|---|---|
| FR | 2579439 | 10/1986 |

OTHER PUBLICATIONS

International Search Report and Written Opinion for International (PCT) Patent Application No. PCT/US2016/059044, mailed Jan. 5, 2017. 9 pages.

(Continued)

*Primary Examiner* — Eric J Kurilla

(74) *Attorney, Agent, or Firm* — FisherBroyles, LLP; Craig W. Mueller

(57) ABSTRACT

Various sheet configurations that improve mattress fit are described. For example, sheets having elastic corners, gripping mechanisms, and faceted side panels are provided that enhance sheet-to-mattress fit. The features employed by some or all of the versions of the sheet described herein enhance interconnection of the sheet onto the mattress, wherein sheets securely interconnect to mattresses having rounded corners or maintain fit with mattresses that have portions that selectively move.

20 Claims, 22 Drawing Sheets

(56) References Cited

U.S. PATENT DOCUMENTS

| | | | |
|---|---|---|---|
| 3,179,958 | A | 4/1965 | Cards |
| 3,287,749 | A | 11/1966 | Marsico |
| 3,493,980 | A | 2/1970 | Haller |
| 3,530,487 | A | 9/1970 | Beer |
| 3,570,026 | A | 3/1971 | Allison |
| 3,581,322 | A | 6/1971 | Marsico |
| 3,591,875 | A | 7/1971 | Zipf, III et al. |
| 3,789,441 | A | 2/1974 | Weiss |
| 3,857,124 | A | 12/1974 | Hadley |
| 3,950,800 | A | 4/1976 | Garshfield |
| 4,266,307 | A | 5/1981 | Critelli |
| 4,301,561 | A | 11/1981 | McLeod |
| 4,388,738 | A | 6/1983 | Wagner |
| 4,389,744 | A | 6/1983 | Monroe |
| 4,488,323 | A | 12/1984 | Colburn |
| 4,490,866 | A | 1/1985 | Stanton |
| 4,494,262 | A | 1/1985 | Robertson |
| 4,662,013 | A | 5/1987 | Harrison |
| 4,809,376 | A | 3/1989 | Boldra |
| 4,903,361 | A | 2/1990 | Tang |
| 4,922,565 | A | 5/1990 | Blake |
| 4,951,335 | A | 8/1990 | Eady |
| 5,003,655 | A | 4/1991 | Kafai |
| 5,027,456 | A | 7/1991 | Wadsworth |
| 5,042,099 | A | 8/1991 | Brenner et al. |
| 5,065,485 | A | 11/1991 | Zocco |
| 5,086,530 | A | 2/1992 | Blake |
| 5,099,531 | A | 3/1992 | Schmier |
| 5,101,527 | A | 4/1992 | Wadsworth et al. |
| 5,134,736 | A | 8/1992 | Anthony et al. |
| 5,136,741 | A | 8/1992 | Balonick et al. |
| 5,208,926 | A | 5/1993 | Stackhouse |
| 5,321,862 | A | 6/1994 | Campbell |
| 5,325,554 | A | 7/1994 | Lewis |
| 5,398,354 | A | 3/1995 | Balonick et al. |
| 5,414,882 | A | 5/1995 | Goodale |
| 5,628,093 | A | 5/1997 | Goodale |
| 5,644,811 | A | 7/1997 | Cavazos |
| 5,794,285 | A | 8/1998 | Burch |
| 5,966,759 | A | 10/1999 | Sanders |
| 6,044,503 | A | 4/2000 | McClendon |
| 6,098,219 | A | 8/2000 | Milber |
| 6,108,836 | A | 8/2000 | Keene, III |
| 6,243,895 | B1 | 6/2001 | Amin |
| 6,263,532 | B1 | 7/2001 | Miller |
| 6,757,923 | B2 | 7/2004 | Sopher et al. |
| 6,859,962 | B2 | 3/2005 | Diak/Ghanem |
| 6,886,197 | B1 | 5/2005 | Madigan |
| 7,007,325 | B1 | 3/2006 | Gomeh |
| 7,047,580 | B2 | 5/2006 | Finn |
| 7,231,679 | B2 | 6/2007 | Ho |
| 7,487,561 | B2 | 2/2009 | Ho |
| 7,669,257 | B2 | 3/2010 | Swihart |
| 7,827,633 | B2 | 11/2010 | Taylor |
| 7,975,334 | B1 | 7/2011 | Vensel |
| 8,032,959 | B2 | 10/2011 | Rowson et al. |
| 8,082,612 | B2 | 12/2011 | Saunders |
| 8,122,541 | B1 | 2/2012 | Georgatos |
| 8,321,980 | B2 | 12/2012 | Maloney |
| 8,332,976 | B1 | 12/2012 | Goldwater |
| 8,393,025 | B2 | 3/2013 | Crispino et al. |
| 8,627,521 | B2 | 1/2014 | Rowson et al. |
| 8,707,482 | B1 | 4/2014 | Ramthun |
| 8,726,907 | B2 | 5/2014 | Strauch et al. |
| 8,898,834 | B1 | 12/2014 | Huber et al. |
| 8,898,835 | B2 | 12/2014 | Khan |
| 9,021,631 | B2 | 5/2015 | Miner |
| 9,549,625 | B1 | 1/2017 | Wilkinson |
| 9,924,813 | B1 | 3/2018 | Basten et al. |
| 10,368,654 | B2 | 8/2019 | Sopher |
| 10,610,034 | B2 | 4/2020 | Sturgeon |
| 10,624,475 | B2 | 4/2020 | Holt |
| 10,743,686 | B2 | 8/2020 | Mansoor |
| 11,071,395 | B1 | 7/2021 | Sopher |
| 12,004,653 | B1 * | 6/2024 | Sopher ..... A47G 9/02 |
| 2002/0116763 | A1 | 8/2002 | Weir |
| 2002/0148047 | A1 | 10/2002 | Corzani |
| 2003/0000014 | A1 | 1/2003 | Sopher |
| 2003/0106157 | A1 | 6/2003 | Rugset |
| 2003/0177579 | A1 | 9/2003 | Diak |
| 2004/0031100 | A1 | 2/2004 | Creech |
| 2004/0139552 | A1 | 7/2004 | Walters |
| 2005/0177942 | A1 | 8/2005 | Finn |
| 2005/0217030 | A1 | 10/2005 | Seigler |
| 2007/0113341 | A1 | 5/2007 | Ho |
| 2007/0174962 | A1 | 8/2007 | Smith |
| 2008/0289104 | A1 | 11/2008 | Rowson |
| 2009/0106901 | A1 | 4/2009 | Wootten, Jr. |
| 2009/0172881 | A1 | 7/2009 | Peterson |
| 2009/0265855 | A1 | 10/2009 | Hawk |
| 2010/0154122 | A1 | 6/2010 | Crispin et al. |
| 2010/0223726 | A1 | 9/2010 | Maloney |
| 2014/0075672 | A1 | 3/2014 | Marcik |
| 2014/0143954 | A1 | 5/2014 | Miner |
| 2015/0026887 | A1 | 1/2015 | Taylor |
| 2015/0182032 | A1 | 7/2015 | Jensen |

OTHER PUBLICATIONS

"ZippySack," Jay at Play, believed to be sold as early as Oct. 22, 2013, retrieved from www.zirovsack.com, retrieved on May 5, 2017, 6 pages.

"Beddingo" https://www.kickstarter.com/projects/beddingo/beddingo-the-first-reinvention-of-sheets-in-100-ye. Believed to be publicly available Mar. 2019. 32 pages.

Notice of Allowance from related U.S. Appl. No. 15/929,701, filed Sep. 18, 2020.7 pages.

Final Action for U.S. Appl. No. 14/516,572, mailed Nov. 10, 2016, 15 pages.

Official Action for U.S. Appl. No. 14/516,572, mailed Jun. 13, 2016, 30 pages.

Notice of Allowance for U.S. Appl. No. 13/420,143, mailed Oct. 24, 2016, 5 pages.

Official Action for U.S. Appl. No. 13/420,143, mailed Sep. 22, 2016, 11 pages.

Official Action for parent U.S. Appl. No. 16/706,756, mailed Oct. 15, 2020, 9 pages.

* cited by examiner

BEDDING SYSTEMS

This application is a continuation of U.S. patent application Ser. No. 17/443,488, filed Jul. 27, 2021, now U.S. Pat. No. 12,004,653, issued Jun. 11, 2024, which is a continuation-in-part of U.S. patent application Ser. No. 16/706,756, filed Dec. 8, 2019, now U.S. Pat. No. 11,701,395, issued Jul. 27, 2021, which claims the benefit of U.S. Provisional Patent Application Ser. No. 62/777,179, filed Dec. 9, 2018, the entireties of which are incorporated by reference herein.

This application is also related to U.S. patent application Ser. No. 16/531,577, filed Aug. 5, 2019, which is a continuation of U.S. patent application Ser. No. 15/335,844, filed Oct. 27, 2016, now U.S. Pat. No. 10,368,654, issued Aug. 6, 2019, which claims the benefit of U.S. Provisional Patent Application Ser. No. 62/247,188, filed Oct. 27, 2015, the entirety of each being incorporated by reference herein.

This application also incorporates by reference the entirety of related U.S. Pat. No. 6,757,923.

FIELD OF THE INVENTION

Embodiments of the present invention relate generally to a bedding system. More specifically, the bedding system includes a retention element retained on a bed mattress. A first bedding element is removably interconnectable to the retention element. The bedding system may optionally include a second bedding element removably interconnectable to the first bedding element. In this manner, the first and second bedding elements may be removably interconnected to the mattress by the retention element.

Other embodiments of the present invention are generally related to systems and methods for improving bedding, which includes systems for facilitating insertion of a duvet into a duvet cover, devices for maintaining the duvet within the duvet cover, systems for concealing an outer periphery of a mattress, and systems that enhance sheet-to-mattress engagement.

BACKGROUND AND SUMMARY OF THE INVENTION

When a bed is slept in, sheets become loose and blankets may slide off of the bed and end up on the floor. Because of this, the occupant's sleep may be interrupted to rearrange the sheets or retrieve the blanket from the floor. This is particularly a problem during non-domestic sleep experiences for beds located in recreational vehicles, campers, and tents.

Additionally, making up the bed after it has been slept in is often difficult and time consuming because sheets and blankets frequently become disarrayed due to occupant movement. To change or straighten the sheets they must often be pulled over (in the case of a fitted sheet) and/or tucked underneath the mattress (in the case of a flat sheet). The mattress weight and design and bed frame design can all contribute to difficulty in making up the bed or changing the sheets. External factors, such as bed rails, furniture around the bed, and walls close to the bed, may further increase the difficulty of making up the bed or changing the sheet by limiting access to the bed.

Thus, there is a need for a bedding system that improves both sheet function as well as bed covers to create case of changing sheets, case of making the bed, and a more comfortable sleep experience.

Some embodiments of the present invention provide a bedding system for a mattress that is easy to change and stays securely on the mattress. The bedding system generally comprises a retention element and a first bedding element selectively interconnected to the retention element. Optionally, a second bedding element may be interconnected to the first bedding element. The bedding system also improves safety for babies and young children by mitigating entrapment hazards, and limits corners from popping off during placement on the mattress or during sleep.

One aspect of the bedding system is that it is easy to fold. The bedding system may be washed and dried as one piece with its components interconnected. Alternatively, one or more portions of the bedding system may be washed and dried separately.

It is another aspect of embodiments of the present invention to provide a retention element sized to be retained on a mattress. The retention element includes at least one part of a closure to receive a first bedding element. In one embodiment, the retention element does not contact a bottom surface portion of the mattress. In another embodiment, the retention element contacts a portion of the mattress bottom. Optionally, the retention element may substantially all, or all, of the mattress bottom. The retention element may be interconnected to the mattress by, for example, one or more fasteners. In one embodiment, the retention element includes button holes that align with buttons positioned on mattress. Alternatively, the retention element may be interconnected to the mattress by one or more two-part closures, such as snaps, a hook and loop systems, and zippers.

It is another aspect of some embodiments of the present invention to provide a first bedding element that is selectively interconnectable to a mattress of a bed. In one embodiment, the first bedding element is interconnectable to the retention element and, optionally, to a second bedding element. In another embodiment, the first bedding element is interconnectable directly to the bed mattress without use of the retention element. The first bedding element generally includes at least one part of a closure for interconnection to the retention element or the mattress. In one embodiment, the closure is a two-part closure. Optionally, the first bedding element includes at least one part of a two-part closure for interconnection to the second bedding element. In one embodiment, the first bedding element includes at least one of a button and a button hole for interconnection to one or more of the second bedding element, the retention element, and the mattress. In another embodiment, at least one of the two-part closures is a zipper. In one embodiment, the first bedding element is a sheet. In another embodiment, the second bedding element is one of a sheet, a blanket, and a duvet.

It is still yet another aspect of embodiments of the present invention to provide a second bedding element that is selectively interconnectable to the first bedding element. The second bedding element generally includes at least one part of a two-part closure for interconnection to the first bedding element. In one embodiment, the second bedding element is one of a sheet, a blanket, and a duvet. The duvet may include a pocket accessible by an aperture to selectively receive insulating material to regulate the retention of heat. Optionally, the two-part closure may comprise a zipper or a plurality of buttons that are received in button holes.

It is another aspect of the present invention to provide a bedding system selectively retained by a mattress of a bed. The bedding system comprises: (1) a retention element selectively received by the mattress, the retention element including a first portion of a first closure; (2) a first bedding element selectively interconnectable to the retention element, the first bedding element including: (i) a longitudinal axis; (ii) a second portion of the first closure; (iii) a first portion of a second closure generally parallel to the longitudinal axis; and (iv) a first portion of a third closure generally parallel to the longitudinal axis; and (3) a second bedding element selectively interconnectable to the first bedding element, the second bedding element including: (i) a second portion of the second closure; and (ii) a second portion of the third closure. In one embodiment, the retention element may be interconnected to the mattress by one or more of a hook and loop system, a zipper, buttons, and snaps.

In one embodiment, the first portion of the second closure is closer to a first peripheral edge of the first bedding element than the second portion of the first closure. Additionally, the first portion of the third closure is closer to a second peripheral edge of the first bedding element than the second portion of the first closure.

In some embodiments, the first bedding element further comprises: (i) a medial panel; (ii) a first panel extending from a first longitudinal edge of the medial panel; and (iii) a second panel extending from a second longitudinal edge of the medial panel. The second portion of the first closure is interconnected to the medial panel, the first portion of the second closure is interconnected to the first panel, and the first portion of the third closure is interconnected to the second panel.

In one embodiment, the second bedding element has a width that is greater than a width of the first bedding element. The second portion of the second closure may be interconnected to the second bedding element proximate to a first peripheral edge of the second bedding element and the second portion of the third closure may be interconnected to the second bedding element proximate to a second peripheral edge of the second bedding element. Optionally, each of the second portion of the first closure, the first portion of the second closure, and the first portion of the third closure are interconnected to an interior surface portion of the first bedding element.

The mattress includes four sidewalls. In one embodiment, the retention element includes a first longitudinal panel connected to a second longitudinal panel by first and second transverse panels such that, when the retention element is retained by the mattress, each of the longitudinal panels and the transverse panels contacts at least a portion of one of the four sidewalls of the mattress. Optionally, the retention element includes a bottom panel that contacts at least a portion of a bottom portion of the mattress when the retention element is retained by the mattress. In some embodiments, first bedding element is a sheet and the second bedding element is a duvet including a pocket to receive an insulation.

It is still another aspect of the present invention to provide a bedding system that is selectively interconnectable to a mattress of a bed. The bedding system includes, but is not limited to: (1) a retention element adapted to cover at least a sidewall portion of the mattress, including: (i) a first portion of a first closure; (ii) a first longitudinal panel; (iii) a second longitudinal panel; (iv) a first transverse panel; and (v) a second transverse panel; and (2) a first bedding element including: (i) a medial panel with a second portion of the first closure; (ii) a first panel extending from a first longitudinal edge of the medial panel; and (iii) a second panel extending from a second longitudinal edge of the medial panel such that, when the first and second portions of the first closure are interconnected, the first panel covers at least a portion of the first longitudinal panel and the second panel covers at least a portion of the second longitudinal panel. In one embodiment, the retention element may be interconnected to the mattress by one or more of a hook and loop system, a zipper, buttons, and snaps.

Optionally, the bedding system may further comprise: a second bedding element with a width greater than a width of the first bedding element, the second bedding element interconnectable to the first bedding element. In one embodiment, a two-part closure interconnects the second bedding element to the first bedding element. Optionally, the two-part closure comprises two two-part closures to interconnect the second bedding element to the first bedding element. Alternatively, in another embodiment, buttons interconnect the first and second bedding elements. In one embodiment, the buttons engage apertures in the first bedding element to interconnects the second bedding element to the first bedding element. In another embodiment, buttons affixed to the first bedding element engage apertures in the second bedding element to selectively interconnect the second bedding element to the first bedding element. In still another embodiment, buttons engage buttons apertures in the retention element and the first and second bedding elements to interconnect the first and second bedding elements to the retention element.

It is yet another aspect of the present invention to provide a bedding system selectively interconnectable to a mattress of a bed. The bedding system comprises: (1) a retention element adapted to cover at least a sidewall portion of the mattress; (2) a first bedding element; and (3) a second bedding element, wherein at least the first bedding element and the second bedding element may be interconnected by buttons. Optionally, the first bedding element may include a medial panel, a first panel extending from a first longitudinal edge of the medial panel, and a second panel extending from a second longitudinal edge of the medial panel.

In one embodiment, the first bedding element is interconnected to the retention element by a two-part closure. In another embodiment, the first bedding element is interconnected to the retention element by buttons.

In one embodiment, the bedding system further comprises buttons affixed to the retention element in alignment with button holes formed through the first bedding element and the second bedding element. In one embodiment, the buttons are aligned generally parallel to a longitudinal axis of the first bedding element.

Optionally, in another embodiment, buttons affixed to the first bedding element align with button holes formed in the second bedding element for interconnecting the first and second bedding elements. In still another embodiment, buttons affixed to the second bedding element align with button holes formed in the first bedding element. Alternatively, the bedding system further comprises buttons affixed to the second bedding element in alignment with button holes formed through the first bedding element and the retention element. In another embodiment, button holes are formed through each of the retention element, the first bedding element, and the second bedding element to receive double buttons to interconnect the retention element to each of the first and second bedding elements. In yet another embodiment, the retention element may be interconnected to the mattress by one or more of a hook and loop system, a zipper, buttons, and snaps.

Yet another aspect of the present invention is a method of making a bedding system to be selectively retained by a mattress. The method generally comprising: (1) forming a retention element including a first longitudinal panel connected to a second longitudinal panel by first and second transverse panels and at least one first closure; (2) forming a first bedding element that generally includes: (i) at least one second closure aligned with the at least one first closure of the retention element; and (ii) at least one third closure; and (3) forming a second bedding element that includes at least one fourth closure aligned with the at least one third closure of the first bedding element. In one embodiment, the first, second, third, and fourth closures comprise one or more of a hook and loop system, a zipper system, a plurality of buttons and button holes, and a plurality of snaps. In one embodiment, the at least one third closure comprises two closures positioned proximate to peripheral edges of the first bedding element. The at least one fourth closure of the second bedding element comprises two closures positioned proximate to peripheral edges of the second bedding element in alignment with the two closures of the third closure.

Another aspect of the present invention is a method of making a bed with a bedding system. The method generally includes, but is not limited two: (1) positioning a retention element on a mattress of the bed, the retention element including a first portion of a first closure; (2) positioned a first bedding element proximate to the retention element, the first bedding element including a second portion of the first closure and at least one second closure; (3) interconnecting the second portion of the first closure to the first portion such that the first bedding element is interconnected to the retention element; (4) positioned a second bedding element proximate to the first bedding element, the second bedding element including at least one third closure; and (5) interconnecting the second and third closures such that the second bedding element is interconnected to the first bedding element. In one embodiment, the second and third closures comprise zippers. In another embodiment, the second and third closures comprise buttons and button holes. Optionally, in another embodiment, the method may further include interconnecting the retention element to the mattress with a closure.

As used herein, the phrases "two-part fastener" and "two-part closure" may be any two-part closure known to those of skill in the art or developed in the future. In one embodiment, the two-part closure is a zipper. In another embodiment, the two-part closure is a hook and loop system, such as Velcro™. Alternatively, the two-part closure may comprise snaps or other fasteners.

FIGS. 21 and 22 show a duvet 402 and duvet cover 6. As one of ordinary skill in the art will appreciate, duvet covers 6 commonly possess an opening 410 adjacent to an upper or a lower edge thereof configured to receive the duvet 402. In operation, the duvet 402 is inserted into the duvet cover 6 and, with some difficulty, the corners 414 of the duvet are moved near interior corners 418 of the duvet cover 6. Some duvets and duvet covers maintain the duvet corners adjacent to the interior corners of the duvet cover with straps 422 extending from the interior corners 418 interconnected to anchors 426 sewn into the duvet's corners. One drawback of this method is that it is difficult to complete successfully as external access to at least two of the duvet corners is limited. This drawback is sometimes addressed by turning the duvet cover inside out, fastening the duvet corners to the duvet, and rolling the duvet cover onto the duvet, thereby returning the duvet cover to the correct orientation. This solution is time-consuming and difficult. Accordingly, it is one aspect of some embodiments to provide a duvet cover that is selectively openable and, thus, can accept the duvet easily. In addition, the contemplated duvet cover provides enhanced access to the duvet corners so they can be secured easily to the duvet cover.

It is one aspect of some embodiments of the present invention to provide a sheet system that securely fits onto a mattress, especially mattresses of unconventional shapes. More specifically, traditional sheets do not fit well on dorm or camper mattresses that often employ rounded edge profiles. Accordingly, it is one aspect of some embodiments of the present invention to provide a sheet with systems that facilitate a secure interconnection onto nontraditional mattresses. For example, some embodiments of the present invention employ corner members having elastic segments that enhance the sheet-to-mattress fit.

Other contemplated embodiments provide gripping mechanisms integrated with, or selectively interconnected to, inner surfaces of the sheet that grasp the mattress, which helps secure the sheet to moving mattress. That is, this embodiment is particularly suited for beds that employ a split mattress with segments configured to move relative to each other.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the Summary of the Invention given above and the Detailed Description given below serve to explain the principles of these embodiments.

Figure 1A:
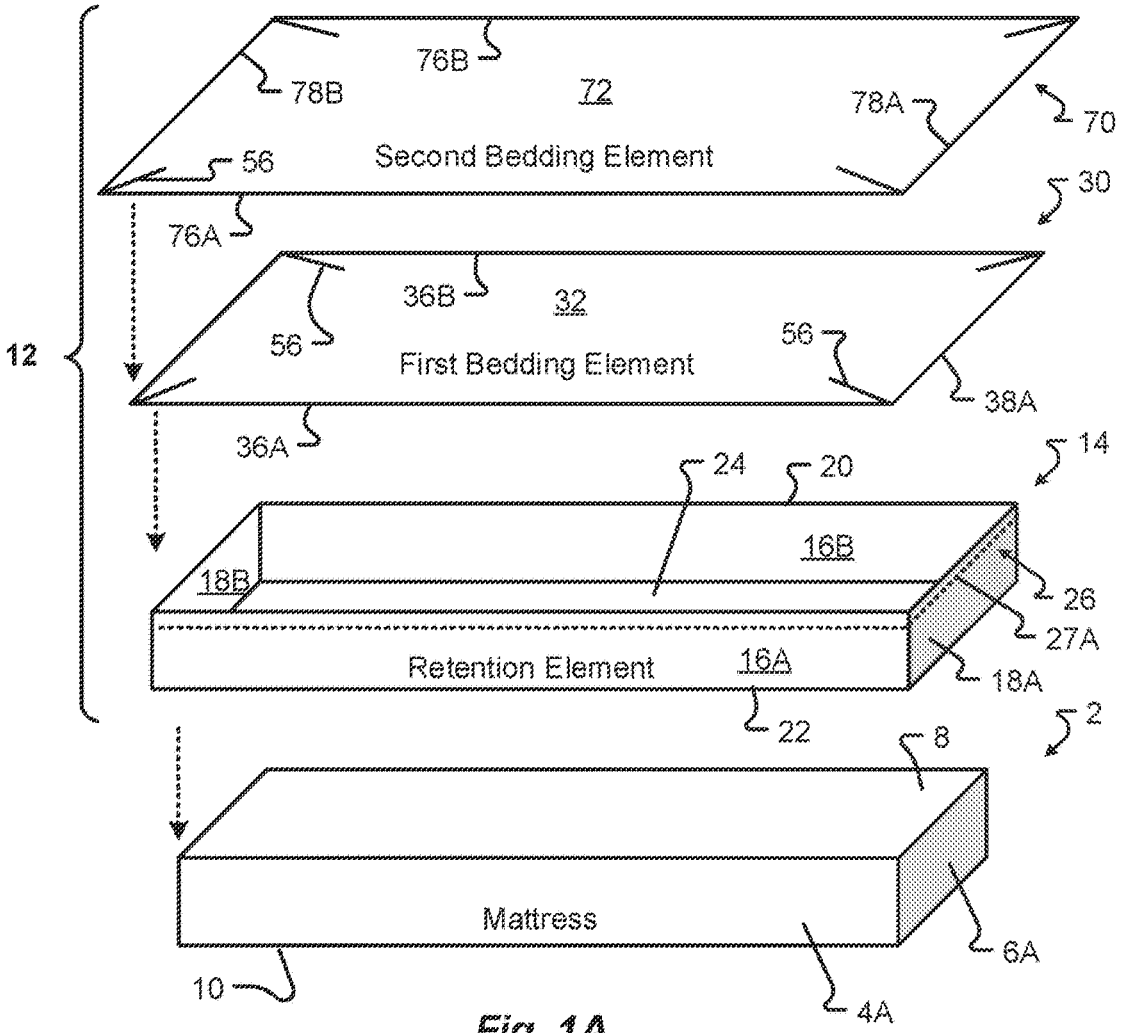
FIG. 1A is an exploded perspective view of a bedding system of an embodiment of the present invention proximate to a mattress of a bed, the bedding system comprising a retention element, a first bedding element, and a second bedding element.

The following component list and associated numbering found in FIGS. 21-42 is provided to assist in the understanding of some embodiments of the present invention:

#Component

402 Duvet
406 Duvet cover
410 Opening
414 Duvet corner
418 Duvet cover corner
422 Strap
426 Anchor
430 Top surface
434 Bottom surface
438 Top edge
442 Bottom edge

446 Left edge
450 Right edge
454 Zipper
455 Access Opening
456 Snap base
458 Snap top
459 Loop
460 Connector
464 Button
468 Member
472 Duvet cover strap
476 Duvet strap
480 Slot
490 Clip
494 Strap

#Component

508 Corner member
510 Side panel
512 Top edge
516 Elastic member
520 Bottom edge
524 Top edge
528 Opening
532 Fabric
600 Sheet
604 Gripping member
608 Inner surface
612 Side panel
616 Top panel
620 Elastic edge
624 Mattress
628 Gripping member
632 Post
636 Button
640 Nut
644 Backing member
700 Sheet
704 Side panel
708 Elastic edge
712 Top panel
716 Upper segment
720 Primary segment
724 Lower segment
728 Mattress

#Component

732 Edge profile
800 Sheet
804 Foot portion
808 Head Portion
812 Split plane
816 Anchor
820 Sheet retention member
824 Stay
828 Elastic member
832 Corner
900 Removable top sheet
904 Side member
908 Mattress
912 Zipper
918 Extension
920 Bottom member It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-5, a bedding system 12 of an embodiment of the present invention is illustrated. The bedding system 12 generally comprises a retention element 14, a first bedding element 30, and a second bedding element 70.

The retention element 14 generally includes a first portion 27A of a first two-part closure 26 and a first longitudinal panel 16A connected to a second longitudinal panel 16B by first and second transverse panels 18A, 18B. In one embodiment, the retention element 14 has a generally rectangular shape.

The retention element 14 generally has a size and shape selected to fit a mattress 2 of a bed. More specifically, the horizontal cross-sectional shape of the retention element 14 generally corresponds to the horizontal cross-sectional shape of the mattress 2. Additionally, the length and width of the retention element 14 are about equal to, or slightly greater than, the corresponding length and width of the mattress 2.

Figure 1B:
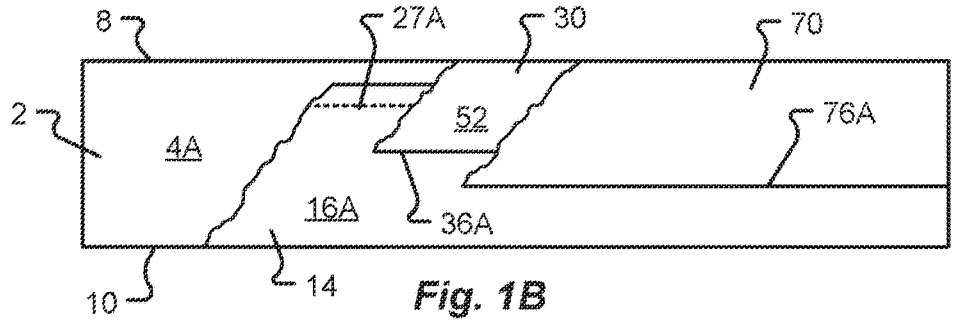
FIG. 1B is a cutaway side elevation view of the bedding system of FIG. 1A illustrating the relative positions of the retention element, the first bedding element, and the second bedding element when the bedding system is positioned on the mattress.

The first and second longitudinal panels 16A, 16B are adapted to contact at least a portion of respective first and second longitudinal sidewalls 4A, 4B of the mattress 2 when the retention element 14 is positioned on the mattress 2. Similarly, the first and second transverse panels 18 contact at least a portion of respective first and second transverse sidewalls 6 of the mattress when the retention element is on the mattress 2. In one embodiment, the panels 16-18 of the retention element 14 substantially cover corresponding sidewalls 4-6 of the mattress 2 as generally illustrated in FIG. 1B. In another embodiment, the panels 16-18 of the retention element 14 contact at least a portion of the top portion 8 of the mattress 2. Optionally, an elastic material or other biasing element may be positioned proximate to one or more of an upper peripheral edge 20 and a lower peripheral edge 22 of one or more of the panels 16-18 to decrease at least one of the length and the width of the retention element 14 with respect to the mattress 2.

In one embodiment, the retention element 14 optionally includes a bottom panel 24 adapted to at least partially contact a bottom portion 10 of the mattress 2. In one embodiment, the bottom panel 24 is continuous between the first and second longitudinal panels 16A, 16B and between the first and second transverse panels 18A, 18B. In this manner, the optional bottom panel 24 may cover all of the bottom portion 10 of the mattress. Alternatively, the bottom panel 24 is discontinuous such that there are apertures in the bottom panel 24 and only some of the bottom portion 10 of the mattress is covered.

Optionally, the first closure portion 27A may extend substantially continuously around the retention element. Accordingly, in one embodiment, each of the panels 16A, 16B, 18A, 18B includes a portion of the first closure portion 27A. Alternatively, one or more of the panels 16A, 16B, 18A, 18B may be devoid of the first closure portion 27A. Thus, in another embodiment, the first closure portion 27A is only included on the first and second longitudinal panels 16A, 16B. In one embodiment, the first closure portion 27A is spaced from an upper peripheral edge 20 of the retention element 14. In another embodiment, the first closure portion 27A is positioned proximate to, or at, the edge 20 of the retention element 14. In one embodiment, the first closure portion 27A is positioned proximate to an upper peripheral edge 20 of the retention element 14. In another embodiment, the first closure portion 27A is substantially parallel to the upper peripheral edge 20. However, one of skill in the art will appreciate that the first closure portion 27A may be arranged at any location of the retention element. Accordingly, in another embodiment, the first closure portion 27A may alternatively be spaced from the upper peripheral edge, or closer to the lower peripheral edge 22 than to the upper peripheral edge.

Figure 1C:
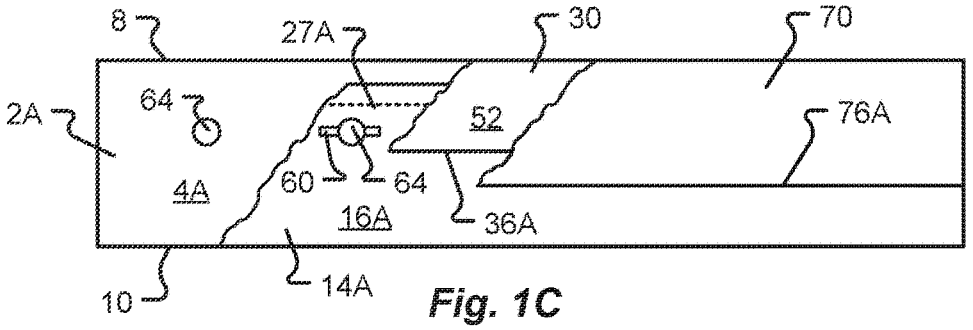
FIG. 1C is a cutaway side elevation view of a bedding system of another embodiment including a retention element interconnected to a mattress with a closure.

Referring now to FIG. 1C, the retention element 14A may optionally be interconnected to the mattress 2A with one or more fasteners or closures. One of skill in the art will appreciate that any type of closure or fastener may be used to interconnect any embodiment of retention element of the present disclosure to the mattress. For example, as illustrated in FIG. 1C, buttons 64 positioned on the mattress 2A may engage button holes 60 formed in the retention element 14A. Alternatively, the retention element 14A may include buttons that engage button loops or button holes formed on the mattress 2A. In another embodiment, one or more of snaps, buttons, a zipper, and a hook and loop fastener are used to interconnect the retention element 14A to the mattress 2A.

The first bedding element 30 generally includes an exterior surface 32 opposite to an interior surface 34, and a first peripheral edge 36A opposite to a second peripheral edge 36B. A second portion 27B of the first closure 26 is interconnected to the interior surface 34 to align with the first portion 27A of the first closure 26. In this manner, the second portion 27B is interconnectable to the first portion 27A of the first closure 26. In one embodiment, the first two-part closure 26 is a zipper. A pull for the first closure 26 may be associated with the second closure portion 27B. Alternatively, the zipper pull may be associated with the first closure portion 27A.

In one embodiment, the first bedding element 30 has at least one of a length that is greater than a length of the longitudinal panels 16 and a width that is greater than a length of the first and second transverse panels 18 of the retention element 14. Accordingly, when the first bedding element 30 is interconnected to the retention element 14, the first and second peripheral edges 36A, 36B drape at least partially down over the first and second longitudinal sidewalls 4A, 4B of the mattress as generally illustrated in FIG. 1B.

Figure 2:
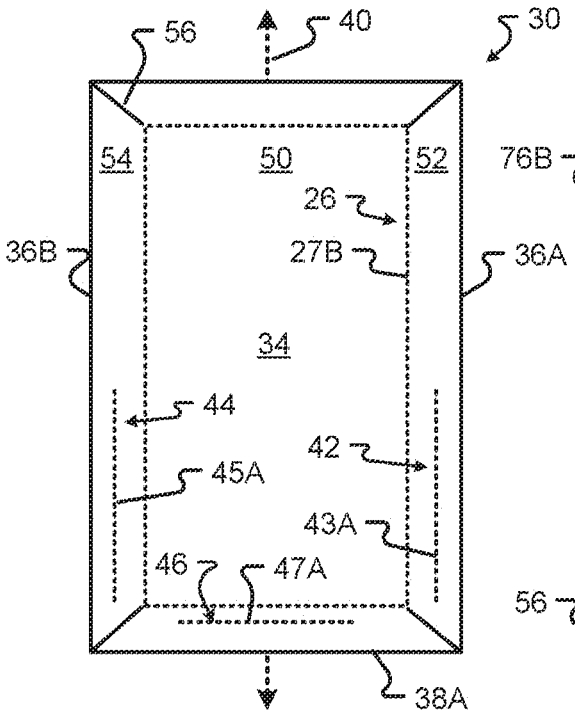
FIG. 2 is a bottom plan view of the first bedding element of the bedding system of FIG. 1A.

Optionally, referring now to FIG. 2, the first bedding element 30 comprises first and second panels 52, 54 that extend from a medial panel 50. In one embodiment, the first and second panels 52, 54 extend about 1 inch from the medial panel 50; however, one of skill in the art will appreciate that the first and second panels 52A, 52B may be of any predetermined width. In another embodiment, the first and second panels extend between about 0.5 inch and about 8 inches from the medial panel 50. Slots 56 may be formed proximate to corners of the first bedding element 30 such that the first and second panels 52, 54 may drape at least partially down against the sidewalls 4 of the mattress. Optionally, a closure, such as but not limited to, a zipper, a snap, or a tie may be interconnected to adjacent sides of one or more of the slots 56. In this manner, the slots 56 may be at least partially closed by the closure.

The first bedding element 30 also includes a first portion 43A of a second two-part closure 42 and a first portion 45A of a third two-part closure 44. In one embodiment, the first portions 43A, 45A are interconnected to the first bedding element at a position substantially parallel to a longitudinal axis 40 of the first bedding element 30 that is substantially equally spaced from the first and second peripheral edges 36A, 36B. Optionally, the first portions 43A, 45A are positioned on the first and second panels 52, 54 respectively. In one embodiment, the first portions 43A, 45A are positioned closer to the respective first and second peripheral edges 36A, 36B than the second portion 27B of the first closure 26. In another embodiment, the first closure 26 is arranged such that the first and second portions 27A, 27B are not between the top portion 8 of the mattress 2 and the interior surface portion 34 of the first bedding element 30 when the first bedding element 30 is positioned on the mattress 2.

Preferably, the first portions 43A, 45A extend along at least a portion of a length of each of the first and second peripheral edges 36A, 36B as illustrated in FIG. 2. For example, in one embodiment, the first portions 43A, 45A of the second and third closures 42, 44 extend up to about one-third of the length of edges 36A, 36B. Alternatively, the first portions 43A, 45A may extend up to about one-half of the length of edges 36. However, in another embodiment, the first portions 43A, 45A have a length substantially equal to the length of the first and second longitudinal sidewalls 4A, 4B of the mattress 2.

Figure 5A:
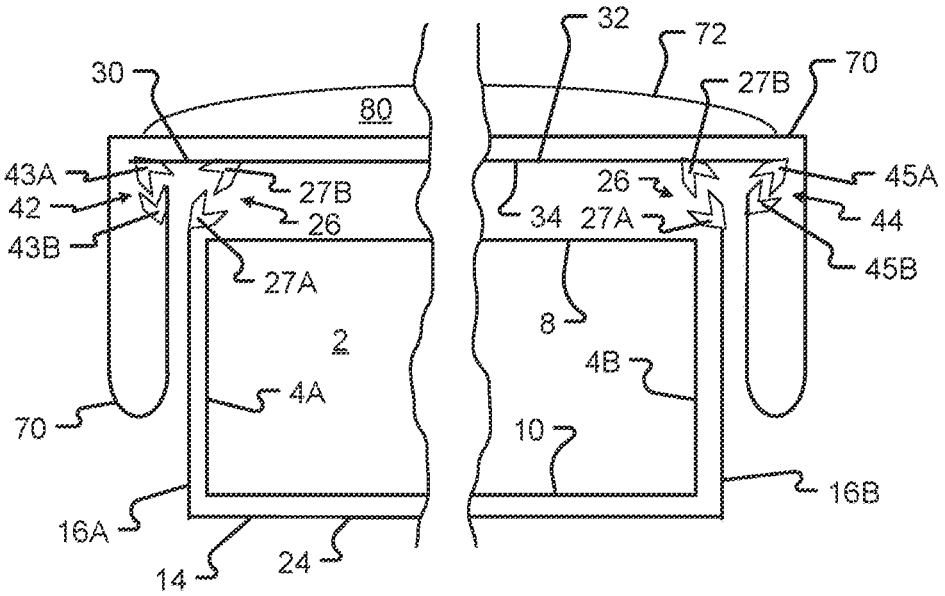
FIG. 5A is a cross-sectional view of the bedding system taken along line 5A-5A of FIG. 4 and illustrating the arrangement of a first closure to interconnect the first bedding element to the retention element and a second closure and a third closure to interconnect the second bedding element to the first bedding element.
Figure 5B:
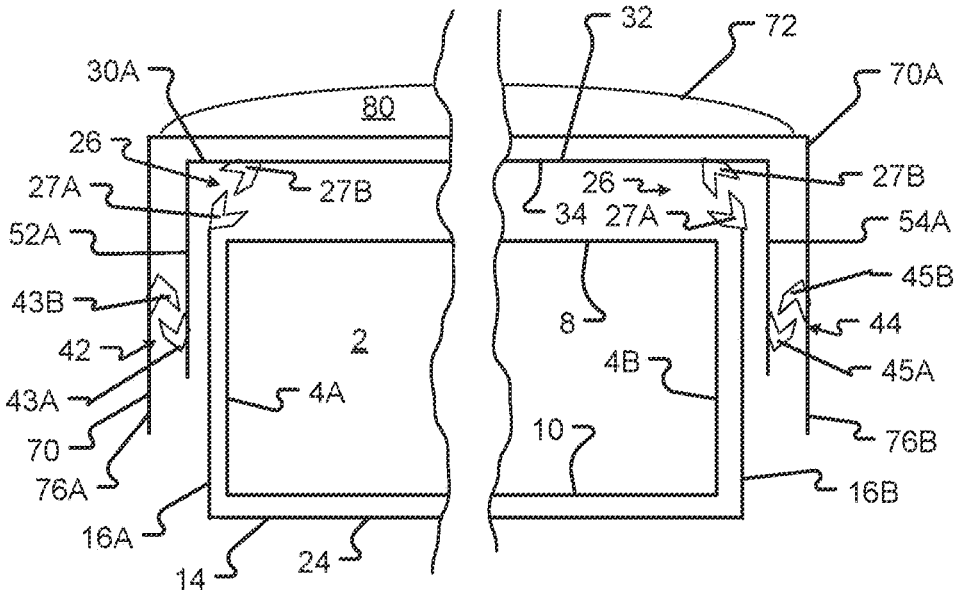
FIG. 5B is another cross-sectional view of the bedding system of FIG. 1 illustrating an alternate position of the second and third closures to interconnect the first and second bedding elements.

In one embodiment, illustrated in FIGS. 2 and 5A, the first closure portions 43A, 45A of the second and third closures 42, 44 are interconnected to the interior surface 34 of the first bedding element 30. Alternatively, the first closure portions 43A, 45A may optionally be interconnected to the exterior surface 32 of the first bedding element 30A as illustrated in FIG. 5B. FIG. 5B also illustrates an embodiment of the first bedding element 30A that is wider than the mattress 2 such that the first and second panels 52A, 52B drape downwardly proximate to the longitudinal panels 16A, 16B of the retention element.

Additionally, the first bedding element 30 may optionally include a first portion 47A of a fourth two-part closure 46. The first portion 47A is preferably arranged substantially perpendicular to the longitudinal axis 40 proximate to a third peripheral edge 38A.

Optionally, the first bedding element 30 may be interconnected directly to the mattress 2 without the use of the retention element 14. Accordingly, one embodiment, the first bedding element 30 includes a second portion 27B of a first two-part closure 26 that interconnects to a first portion 27A of the first closure 26 affixed to the mattress 2. In one embodiment, the first portion 27A is positioned on at least one of the longitudinal sidewalls 4 of the mattress. Optionally, in another embodiment, the first bedding element 30 is interconnected to the mattress 4 by a plurality of buttons or snaps.

In one embodiment, the first bedding element 30 is a sheet. The first bedding element 30 may be formed of any suitable material. In one embodiment, the first bedding element includes cotton. In another embodiment, the first bedding element comprises at least one of cotton, wool, silk, and a synthetic material. Optionally, the first bedding element is pre-washed, or pre-shrunk, before the portions of the two-part closures 26, 42, 44, 46 are affixed to the first bedding element.

The second bedding element 70 generally comprises an exterior surface 72, an interior surface 74, and a first peripheral edge 76A generally parallel to a second peripheral edge 76B. The second bedding element 70 has a shape generally corresponding to the shape of the first bedding element 30. In one embodiment, a width of the second bedding element 70 is greater than the width of the first bedding element 30. Accordingly, when the second bedding element 70 is interconnected to the first bedding element 30 at least a portion of the first bedding element 30 extends downwardly past the first and second peripheral edges 36A, 36B of the first bedding element 30 as illustrated in FIGS. 1B and 5A. Optionally, the second bedding element 70 is longer than the first bedding element 30.

Slots 56 may be formed proximate to corners of the second bedding element 70 similar to the slots 56 of the first bedding element. Closures may be associated with one or more of the slots 56 to draw the slots 56 at least partially closed.

The second bedding element 70 also includes a second portion 43B of the second closure 42 and a second portion 45B of the third closure 44. The second portions 43B, 45B are positioned on the second bedding element 70 to align with the corresponding first portions 43A, 45A of the first bedding element 30. In this manner, the second bedding element may be selectively interconnected to the first bedding element.

In one embodiment, the second portions 43B, 45B are interconnected to the interior surface portion 74. Optionally, the second portions 43B, 45B may be positioned proximate to the respective first and second peripheral edges 76. In this manner, when the second and third closures 42, 44 are interconnected as generally illustrated in FIG. 5A, the second bedding element 70 drapes from the exterior surface portion 32, around the peripheral edges 36A, 36B and proximate to the interior surface portion 34 of the first bedding element 30. In another embodiment, the second portions 43B, 45B may be spaced from the peripheral edges 76A, 76B as illustrated in FIG. 5B.

Optionally, a second portion 47B of the fourth two-part closure 46 may be interconnected to the second bedding element 70 to align with the first portion 47A. In this manner, a foot portion of the first bedding element 30 may be interconnected to the second bedding element. Accordingly, the first and second portions 47A, 47B of the fourth closure 46 may be separated to provide more room for an occupant of the bed. The first and second bedding elements 30, 70 are generally illustrated as interconnectable using three two-part closures 42, 44, and 46; however, one of skill in the art will appreciate that the any one of the two-part closures 42-46 may independently interconnect the first and second bedding elements. Accordingly, in one embodiment, the first and second bedding elements 30, 70 only include one of the closures 42, 44, 46. In another embodiment, the first and second bedding element 30, 70 include any two of the closures 42, 44, 46. Alternatively, the first and second bedding elements may include all three of the closures 42, 44, 46.

The second bedding element 70 may be any type of a sheet or cover for a bed. The second bedding element 70 may comprise one or more of cotton, silk, nylon, wool, and a synthetic material. In one embodiment, the second bedding element 70 is comprised of a durable material suitable for outdoor use. In one embodiment, at least the exterior surface portion 72 of the second bedding element comprises a water-proof or a water-resistant material.

In one embodiment, the second bedding element 70 is a quilt. In another embodiment, the second bedding element 70 is a duvet-type cover comprising two or more layers that define a cavity or pocket 80. The pocket 80 may be sized to retain an insulating material. Thus, insulation may be removed from, or added to, the pocket 80 to adjust the amount of insulation of the second bedding element 70. In this manner, the second bedding element 70 may be adjusted for year-round used, from a summer-weight duvet to a winter-weight duvet. Optionally, retention elements, such as ties, snaps, or hooks, may be positioned within the pocket 80 for interconnected to a selected insulating material.

Figure 3:
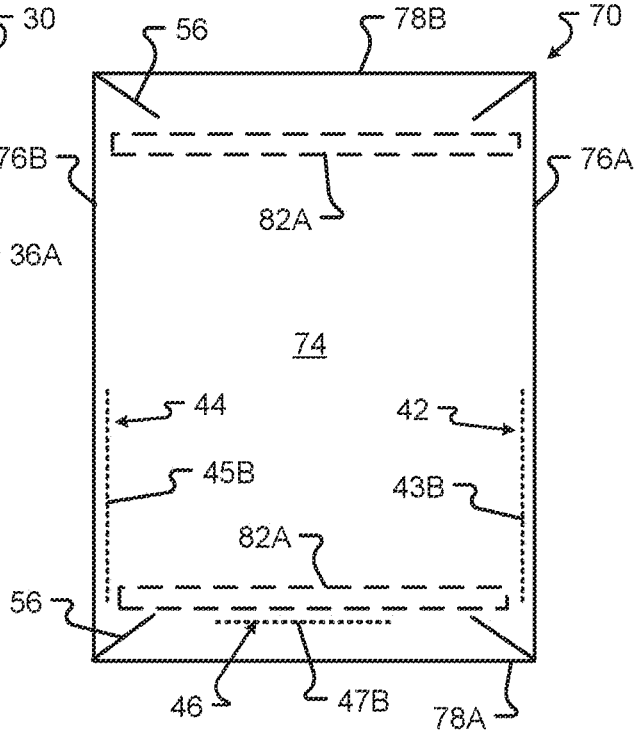
FIG. 3 is a bottom plan view of the second bedding element of the bedding system of FIG. 1A.
Figure 4:
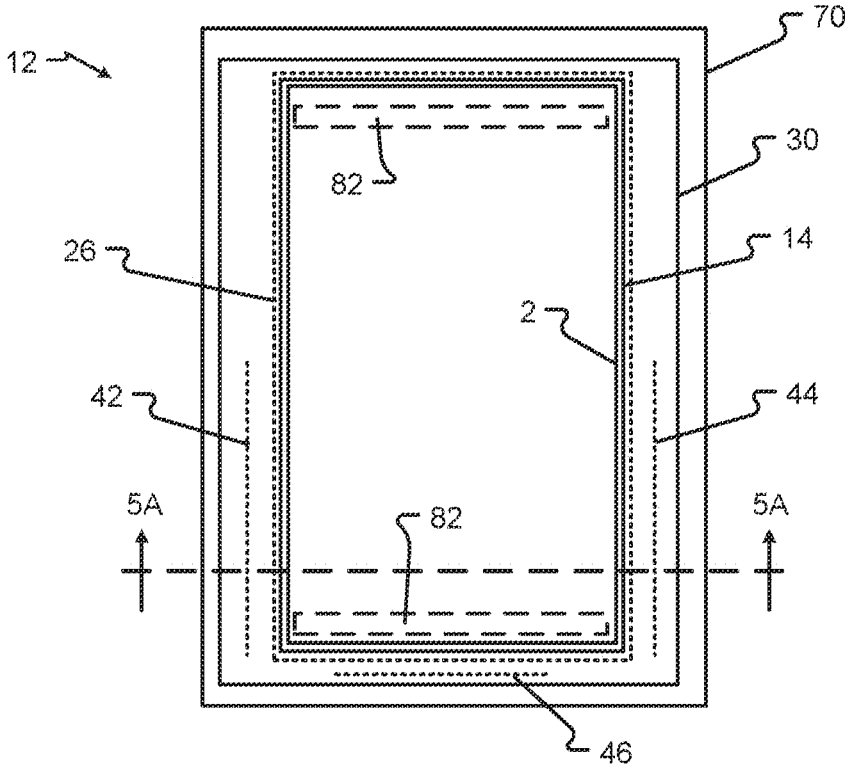
FIG. 4 is a top plan view of the bedding system of FIG. 1A positioned on the mattress of the bed with the mattress, the retention element, and the first bedding element shown through the second bedding element.

Preferably the pocket 80 is closed on at least the first and second peripheral edges 76. Optionally, the pocket 80 is closed proximate to one or more of the foot end 78A and the head end 78B of the second bedding element 70. An aperture 82, illustrated in FIG. 4, for accessing the pocket 80 may optionally be positioned proximate to one or more of the foot 78A and the head 78B of the second bedding element. In one embodiment, the aperture 82 generally comprises a slot in the exterior surface portion 72 of the second bedding element. Alternatively, the aperture 82A is formed in the interior surface portion 74 as illustrated in FIG. 3. Optionally, the aperture 82, 82A may include a closure, such as a zipper, buttons, or snaps. The pocket 80 may be formed on a portion of the width of the second bedding element 70 as illustrated in FIG. 5A. Alternatively, the pocket may generally extend from the first peripheral edge 76A to the second peripheral edge 76B as generally illustrated in FIG. 3.

To replace or clean the bedding system 12, the first and second bedding elements 30, 70 may be individually removed from the retention element 14. Optionally, the first and second bedding elements may be interconnected when the first bedding element 30 is removed from the retention element.

Figure 6:
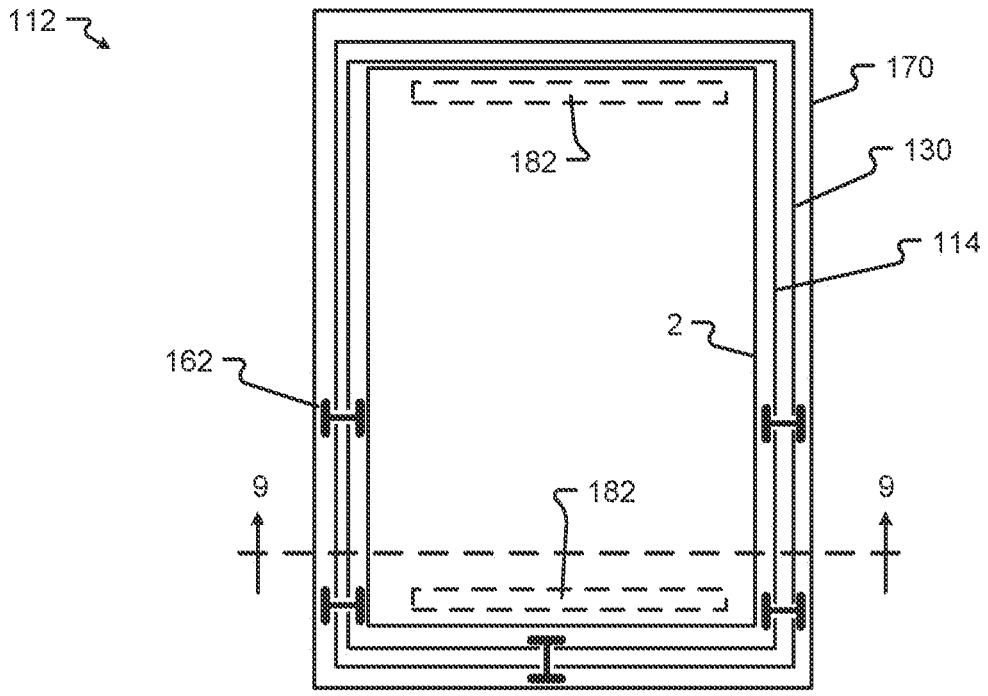
FIG. 6 is a top plan view of a bedding system of another embodiment of the present invention positioned on a mattress and showing a first bedding element and a second bedding element interconnected to a retention element by buttons.
Figure 7:
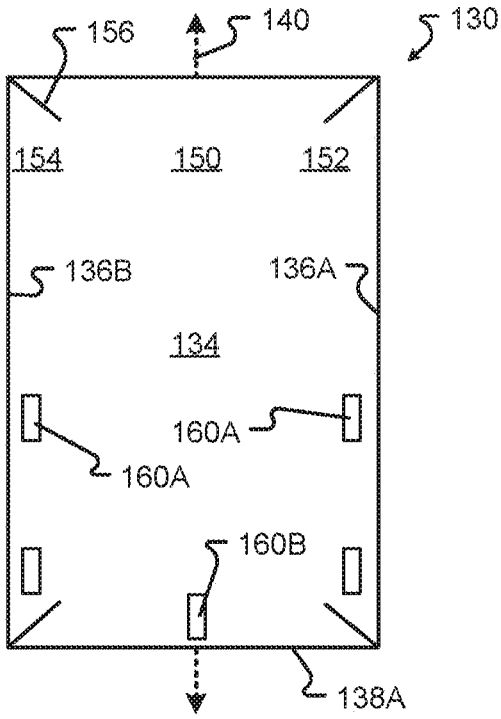
FIG. 7 is a bottom plan view of the first bedding element of the bedding system of FIG. 6.
Figure 8:
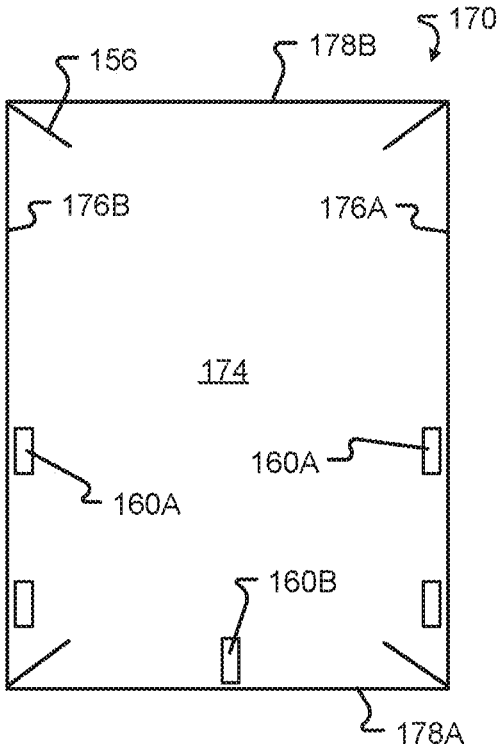
FIG. 8 is a bottom plan view of the second bedding element of the bedding system of FIG. 6.
Figure 9:
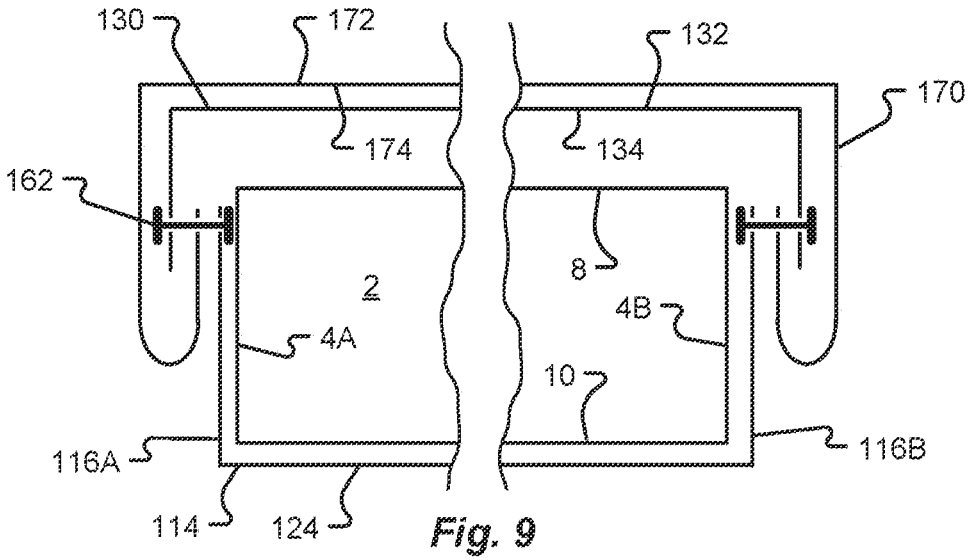
FIG. 9 is a cross-sectional view of the bedding system taken along line 9-9 of FIG. 6 and showing an arrangement of buttons used to interconnect the first and second bedding elements to the retention element.
Figure 10:
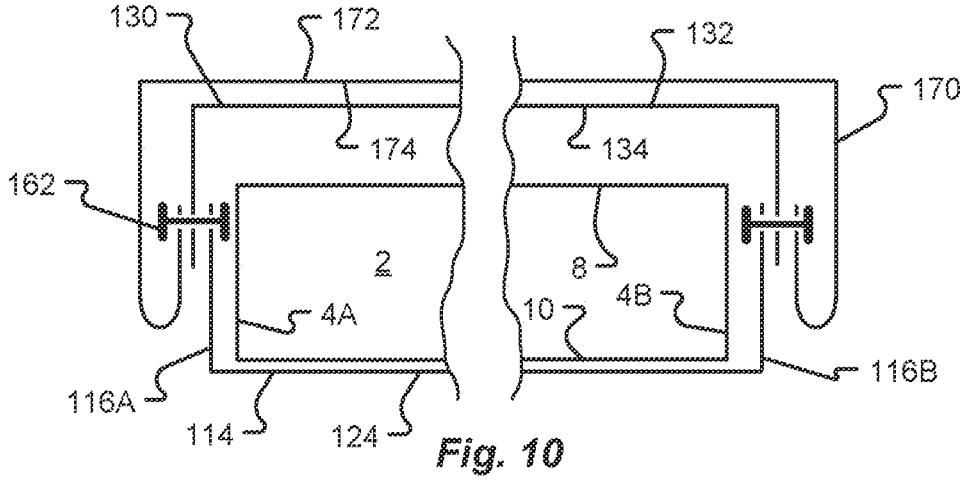
FIG. 10 is a cross-sectional view similar to FIG. 9 illustrating an alternate arrangement of the first and second bedding elements with respect to the buttons.

Referring now to FIGS. 6-10, a bedding system 112 of another embodiment of the present invention is generally illustrated. The bedding system 112 is similar to bedding system 12. However, the first and second bedding elements 130, 170 are interconnected to the retention element 114 by buttons. In one embodiment, the buttons are double buttons 162 with a first head and a second head that are interconnected by a shank. Although only five buttons 162 and button holes 160 are illustrated in FIGS. 6-7, this is merely for clarity. Accordingly, a plurality of buttons 162 and button holes 160 may be associated with bedding system 112.

In one embodiment of the present invention, at least the first and second bedding elements 130, 170 include aligned button holes 160A, 160B. The button holes 160A are generally arranged through the first and second bedding elements about parallel to the longitudinal axis 140 of the first bedding element 130. Said another way, the button holes 160A are arranged similar to the positions of the second and third two-part closures 42, 44 of the bedding system 12. Optionally, button holes 160B may be arranged generally perpendicular to the longitudinal axis 140 such that the foot end 178A of the second bedding element 170 may be interconnected to the first bedding element and, optionally, to the retention element.

Optionally, the retention element 114 may also include button holes 160 that align with the button holes 160 of the first bedding element 130 and, optionally, the second bedding element 170. In this manner, one or more double buttons 162 may be used to interconnect the first and second bedding elements to the retention element 114 as illustrated, for example, in FIGS. 9 and 10.

Figure 11:
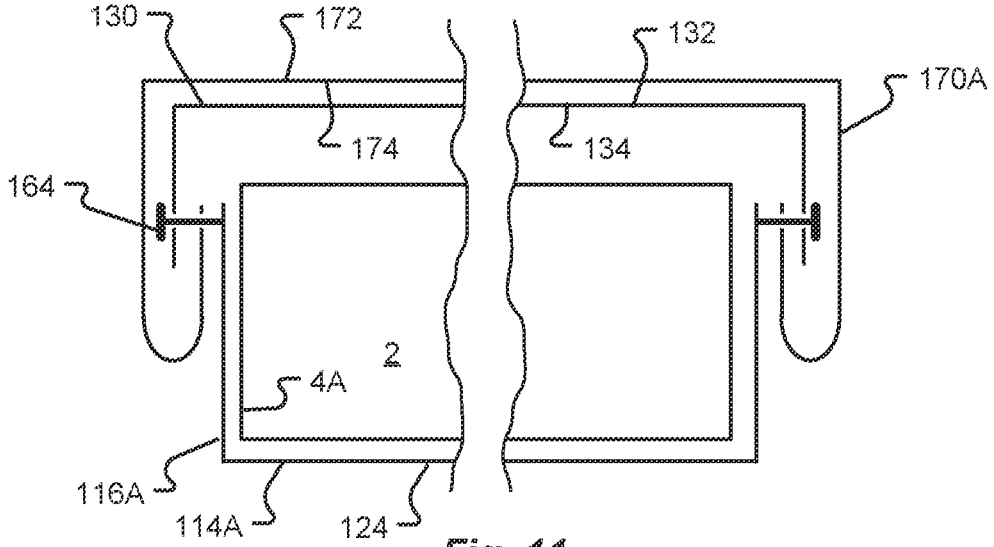
FIG. 11 is still another cross-sectional view similar to FIG. 9 and illustrating the first and second bedding elements interconnected to buttons affixed to the retention element.
Figure 12A:
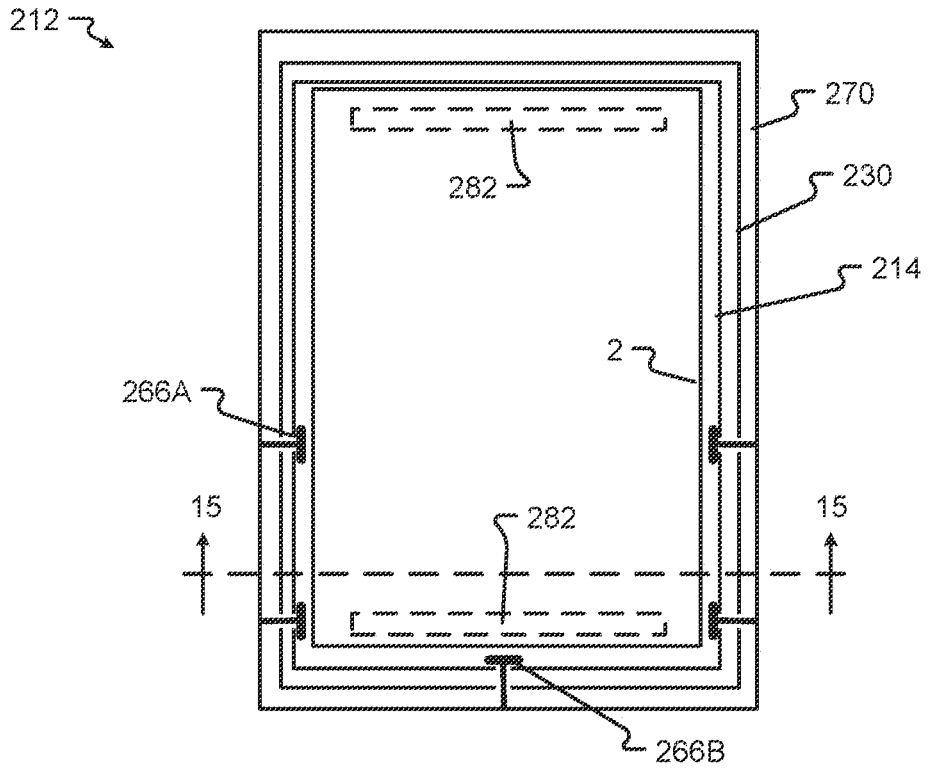
FIG. 12A is a top plan view of another bedding system of an embodiment of the present invention positioned on a mattress and showing a first bedding element and a retention element interconnected to a second bedding element by buttons fixed to the second bedding element.
Figure 12B:
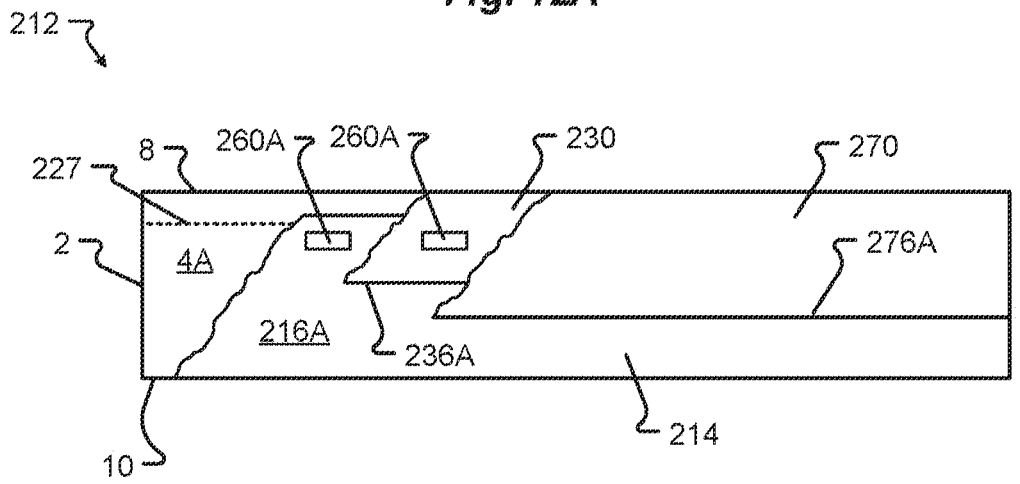
FIG. 12B is a cutaway side elevation view of the bedding system of FIG. 12A illustrating the relative positions of button holes of the retention element and the first bedding element when the bedding system is positioned on the mattress and illustrating an optional zipper to interconnect the retention element to the mattress.
Figure 13:
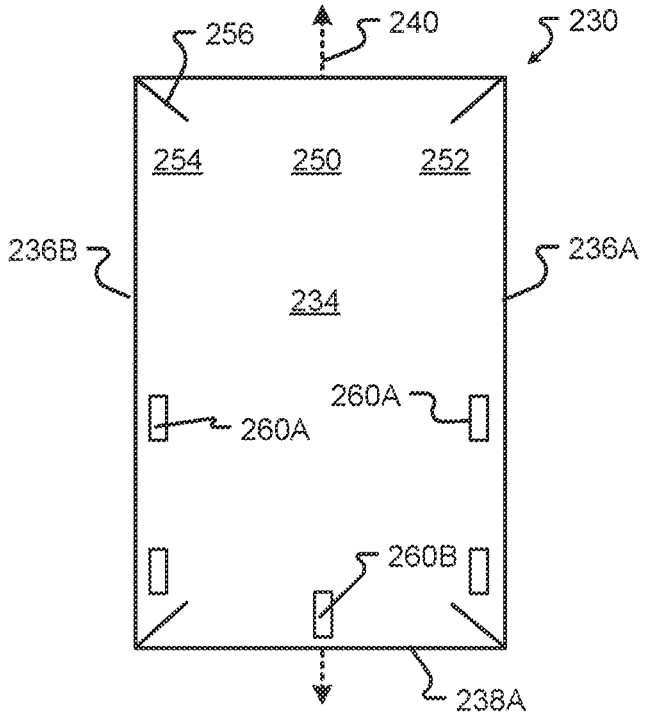
FIG. 13 is a bottom plan view of the first bedding element of the bedding system of FIG. 12A.
Figure 14:
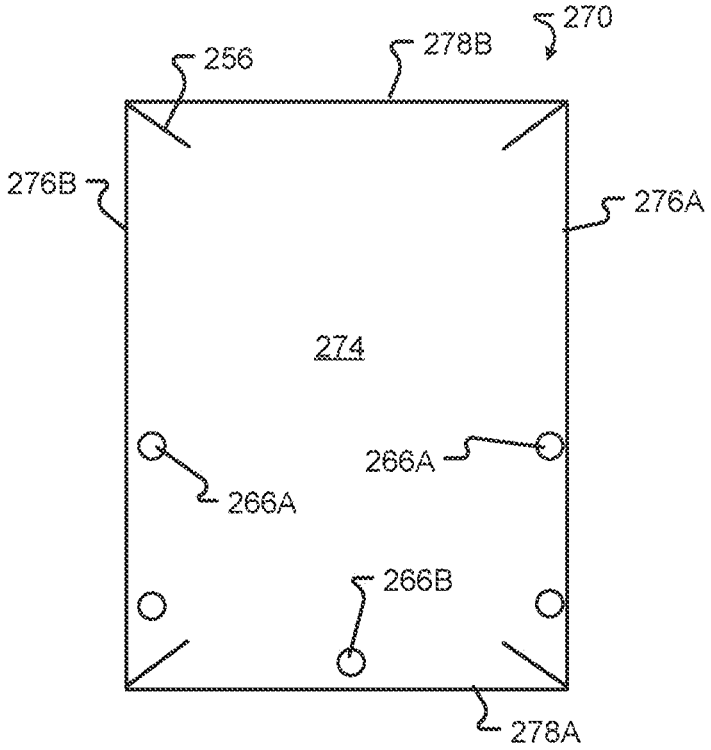
FIG. 14 is a bottom plan view of the second bedding element of the bedding system of FIG. 12A.
Figure 15:
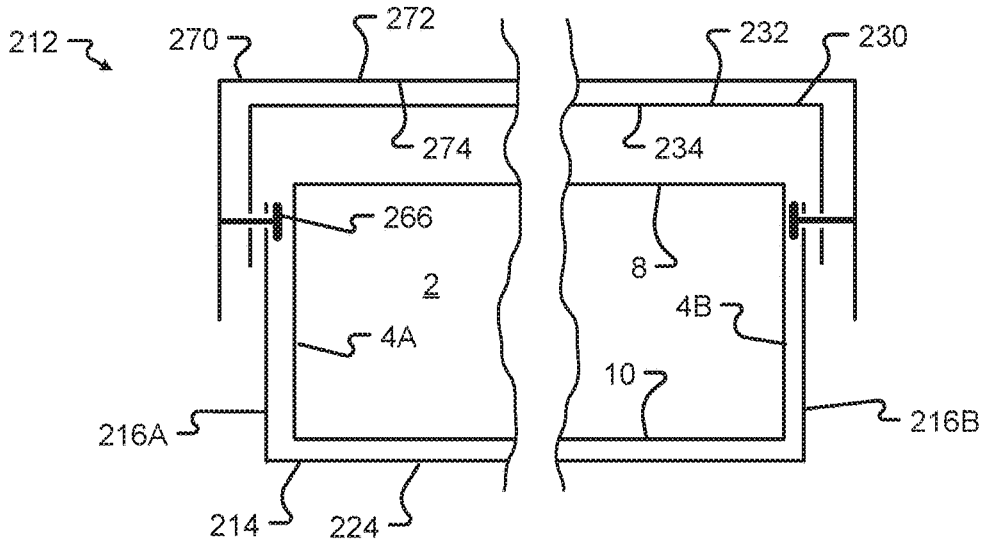
FIG. 15 is a cross-sectional view of the bedding system of FIG. 12A taken along line 15-15 and showing the retention element and the first bedding element interconnected to the second bedding system by buttons affixed to the second bedding element.
Figure 16A:
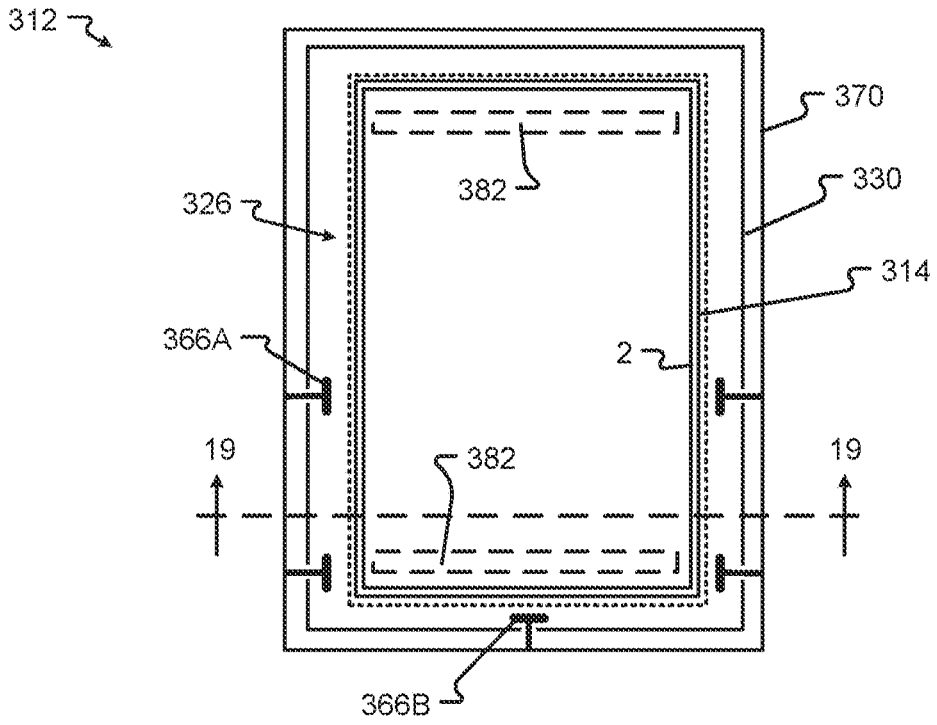
FIG. 16A is a top plan view of yet another bedding system of the present invention and illustrates a retention element positioned on a mattress with a first bedding element interconnected to the retention element by a two-part closure and a second bedding element interconnected to the first bedding element by buttons.
Figure 16B:
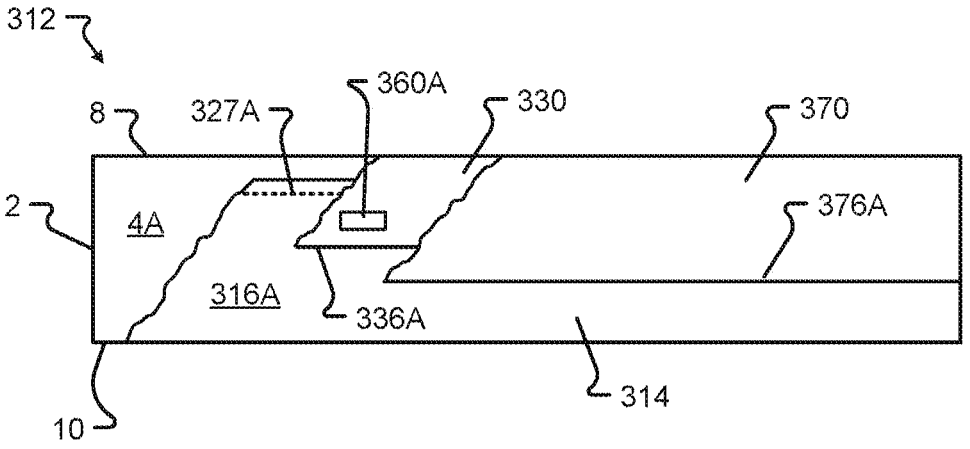
FIG. 16B is a cutaway side elevation view of the bedding system of FIG. 16A illustrating the relative positions of a two-part closure for interconnecting the first bedding element to the retention element as well as button holes of the first bedding element to receive a button affixed to the second bedding element.
Figure 17:
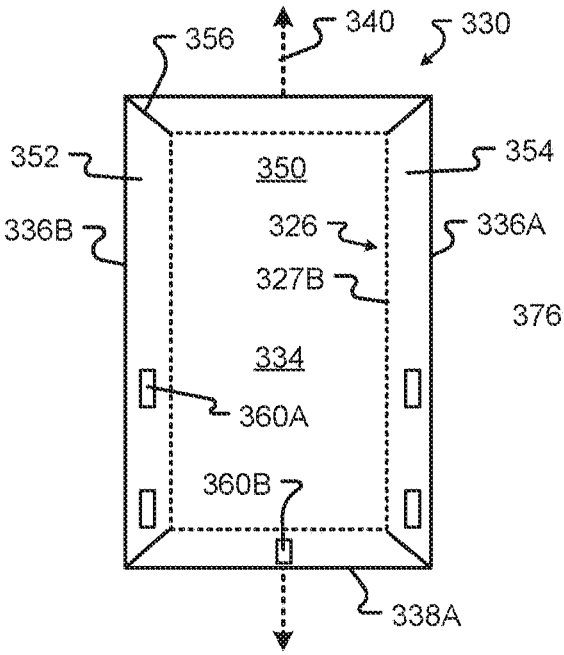
FIG. 17 is a bottom plan view of the first bedding element of the bedding system of FIG. 16A.
Figure 18:
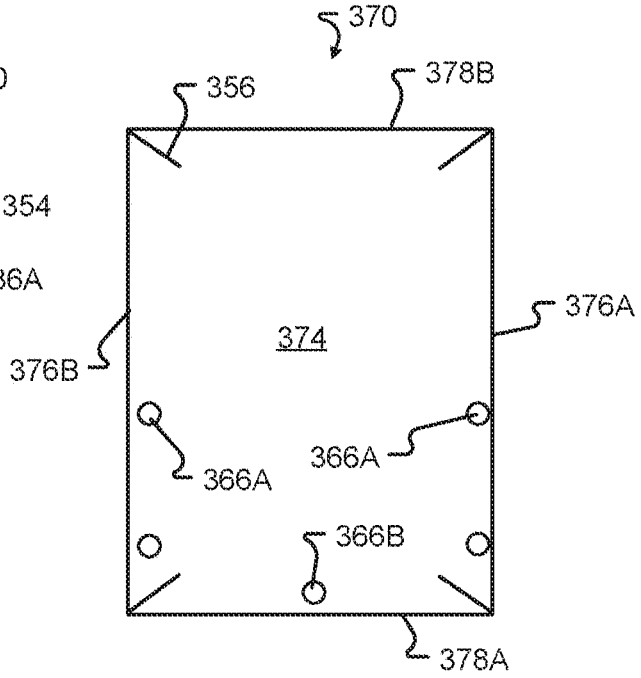
FIG. 18 is a bottom plan view of the second bedding element of the bedding system of FIG. 16A.
Figure 19:
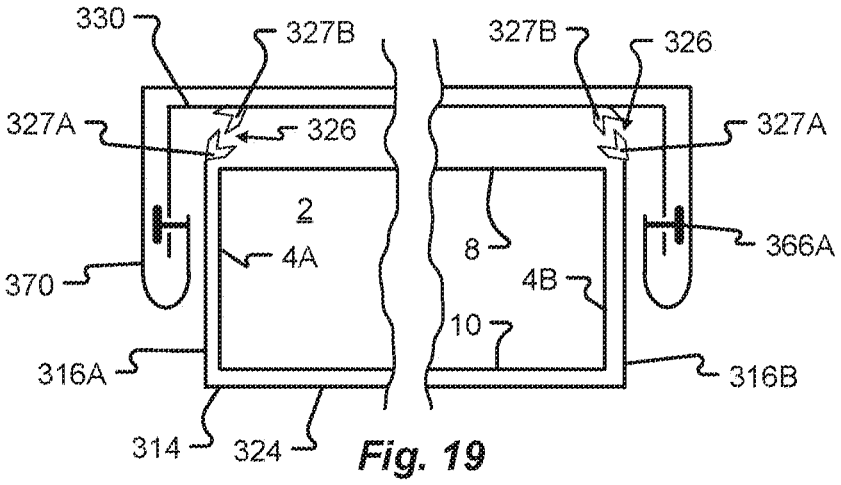
FIG. 19 is a cross-sectional view taken along line 19-19 of FIG. 16A and illustrates the first bedding element interconnected to the retention element by the two-part closure and the second bedding element interconnected to the first bedding element by the buttons.

In another embodiment, illustrated in FIG. 11, the buttons 164 are interconnected to the retention element 114. The buttons 164 are positioned on the retention element 114 to be received through the button holes 160 of the first bedding element 130 and, optionally, the second bedding element 170. Preferably, the buttons are interconnected to the retention element 114 such that sufficient space is left between the button 164 and the retention element 114 to receive one or more of the first bedding element and the second bedding element.

Referring now to FIGS. 12-15, yet another embodiment of a bedding system 212 of the present invention is generally illustrated. The bedding system 212 is similar to bedding systems 12, 112 and includes the same or similar features. More specifically, the bedding system 212 includes button holes 260 on the retention element 214 and the first bedding element 230 aligned with buttons 266 affixed to the second bedding element 270. The buttons 266A and button holes 260B may be positioned generally parallel to the longitudinal axis 240 of the first bedding element 230. Accordingly, the buttons 266A and button holes 260A are generally arranged in positions similar to the second and third closures 42, 44 of bedding system 12. Optionally, buttons 266B and buttons holes 260B may be arranged generally perpendicular to longitudinal axis 240 in a manner similar to the fourth fixture 46 of bedding system 12. As illustrated in FIG. 12B, the mattress 2 may optionally include a first closure portion 227 to engage a corresponding second closure portion (not illustrated) of the retention element 214. In this manner, the retention element 214 may be releasably interconnected to the mattress 2.

Referring now to FIGS. 16-20, still another bedding system 312 of an embodiment of the present invention is illustrated. The bedding system 312 includes both a two-part closure 326 to interconnect a retention element 314 to a first bedding element 330 and buttons 366 and button holes 360 to interconnect a second bedding element 370 to the first bedding element 330. Accordingly, the bedding system is similar to bedding systems 12, 112, 212 and includes the same or similar features.

The retention element 314 includes a first portion 327A of the two-part closure 326. A second portion 327B of the two-part closure 326 is affixed to the interior surface 334 of the first bedding element 330 in alignment with the first portion 327A. Accordingly, the first bedding element 330 may be selectively interconnected to the retention element 314 in a manner the same as, or similar to, the retention element 14 and first bedding element 30 of bedding system 12.

The first bedding element 330 also includes button holes 360 to receive buttons 366 affixed to an interior surface 374 of the second bedding element 370. The buttons 366A and button holes 360A are generally parallel to a longitudinal axis 340 of the first bedding element 330. In one embodiment, the buttons 366A and buttons holes 360A are arranged similar to the second and third two-part closures 42, 44 of bedding system 12. Optionally, additional button holes 360B and buttons 366B may be positioned on the first and second bedding elements 330, 370 substantially perpendicular to the longitudinal axis 340 similar to the fourth two-part closure 46 of bedding system 12. In this manner, the foot end 378A of the second bedding system 370 may be selectively interconnected to the first bedding system 330.

Figure 20:
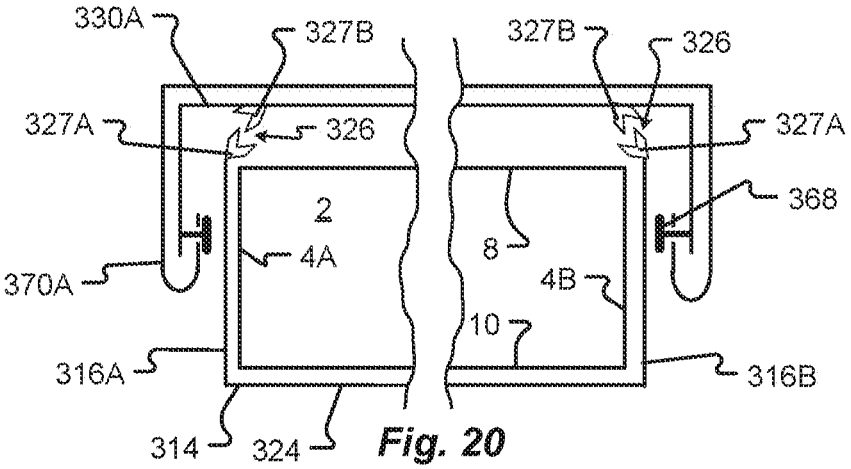
FIG. 20 is another cross-sectional view similar to FIG. 19 and illustrating another bedding system in which a two-part closure interconnects a first bedding element to a retention element and buttons affixed to the first bedding element interconnect the second bedding element to the first bedding element.
Figure 21:
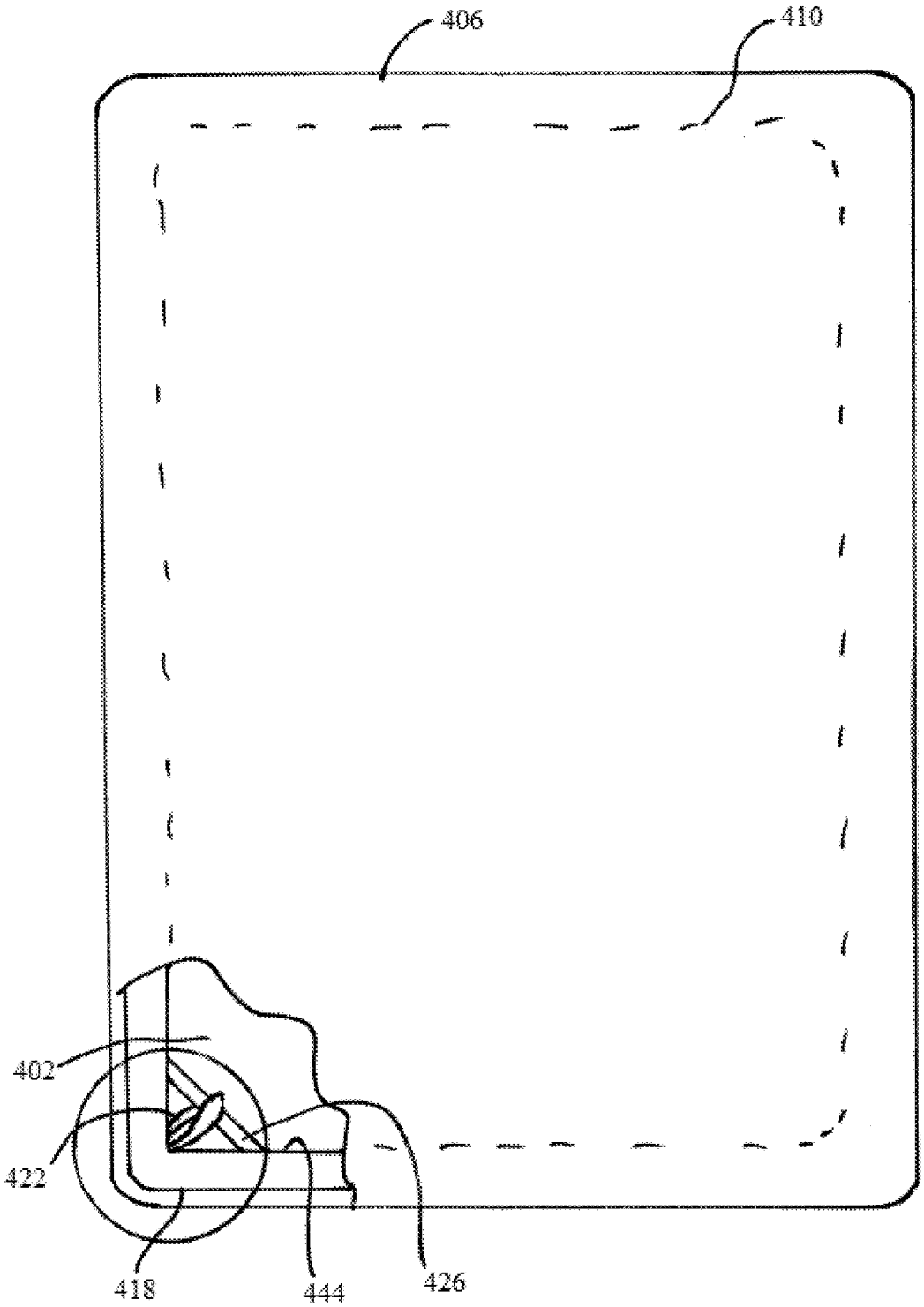
FIG. 21 (PRIOR ART)
FIG. 21 shows a duvet and duvet cover of the prior art.
Figure 22:
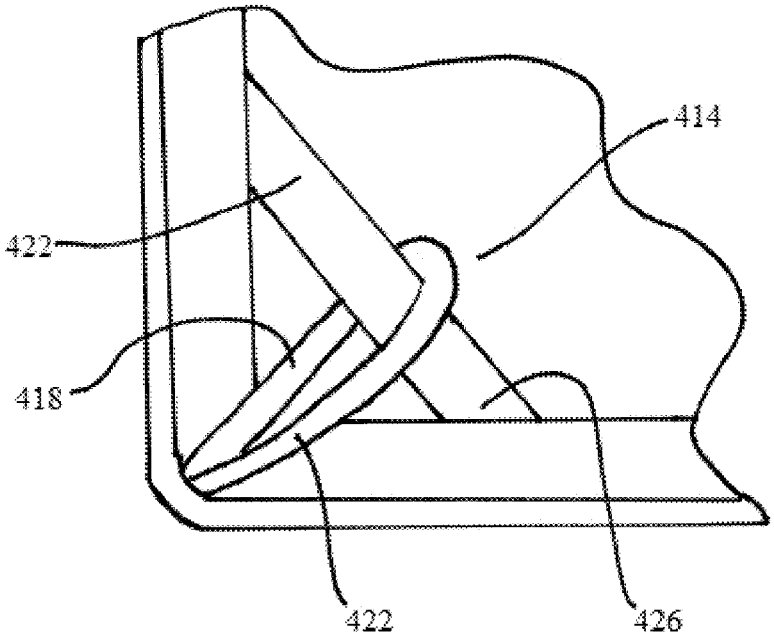
FIG. 22 (PRIOR ART)
FIG. 22 is a detailed of FIG. 21.
Figure 23:
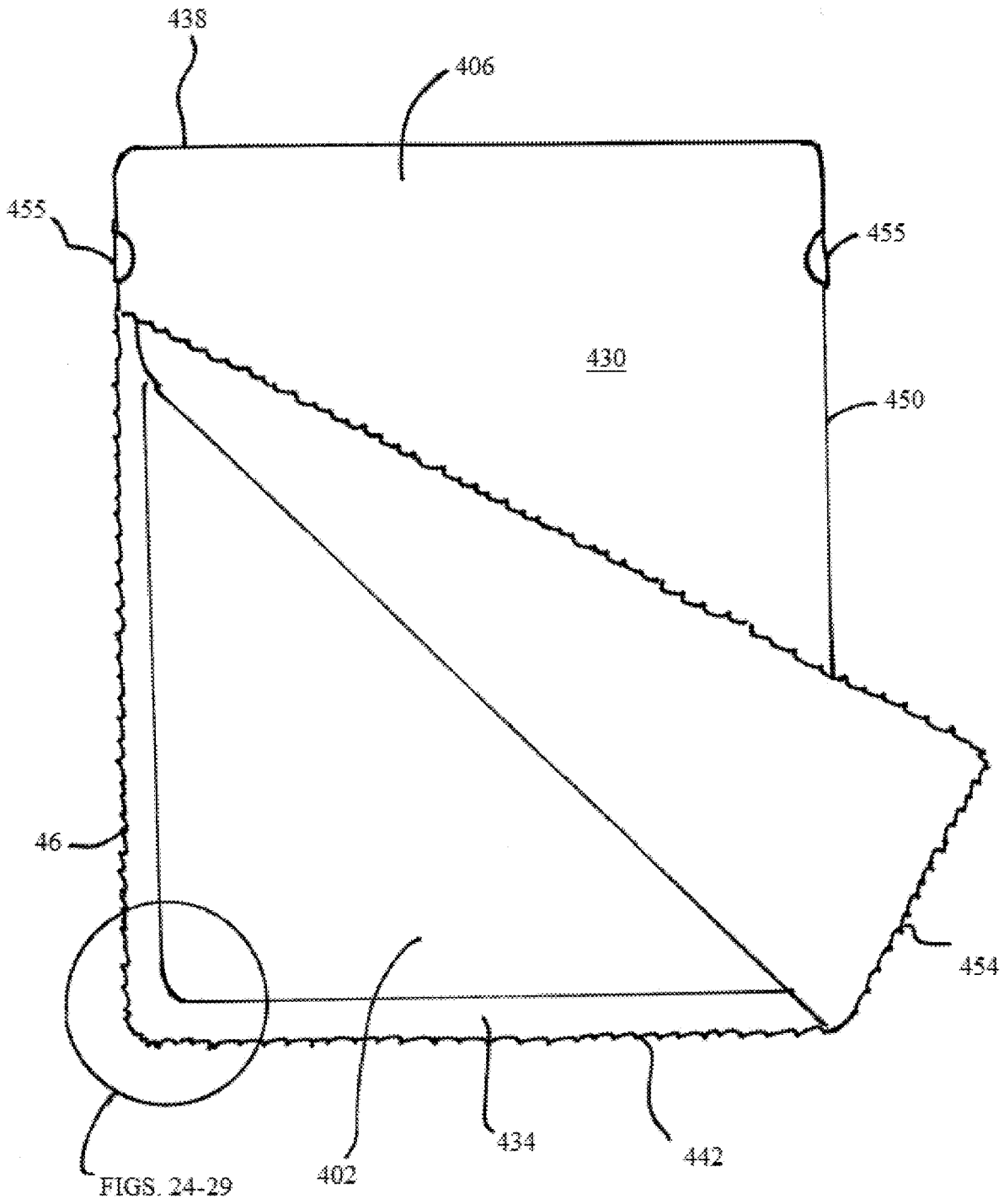
FIG. 23 shows a duvet cover of one embodiment of the present invention.

Referring now to FIG. 20, in another embodiment, the second bedding element 370A includes buttons holes 360 that are aligned with buttons 368 affixed to the first bedding element 330.

FIGS. 23-29 show systems for interconnecting duvets 402 to duvet covers 406. The duvet cover 406 generally comprises a top surface 430 and a bottom surface 434 connected on their respective top edges 438, bottom edges 442, left edges 446, and right edges 450. To facilitate placement of the duvet 402 within the duvet cover 406, however, at least two adjoining edges are selectively interconnected by, for example, with a zipper 454. Those of ordinary skill in the art will appreciate that other selective interconnection mechanisms, such as zip locks, magnets, hook and loop fasteners, snaps, or buttons may be employed without departing from the scope of the invention. The selective interconnection mechanism may be concealed within seams associated with the top surface 430 to the bottom surface 434 or by flaps that extend from the edges of the top or bottom surface.

In operation, the selectively interconnected edges are separated to expose the interior of the duvet cover 406, which allows for quick and easy insertion of the duvet 402. Thus, the user is provided with greater access to the duvet cover interior which allows the duvet to be aligned correctly relative to the top surface and the bottom surface. Thereafter, the open edges are reconnected.

The duvet cover of some embodiments of the present invention also includes access openings 455 located on the edges or portions of the edges that are not severable. In the embodiment shown, the access openings 455 are provided on the left edge 46 and right edge 450 and adjacent to the top edge 438 of the duvet cover 406 the access openings allow access into the interior so the top corners of the duvet 402 may be adjusted and aligned with corresponding interior corners of the duvet cover 406.

Figure 24:
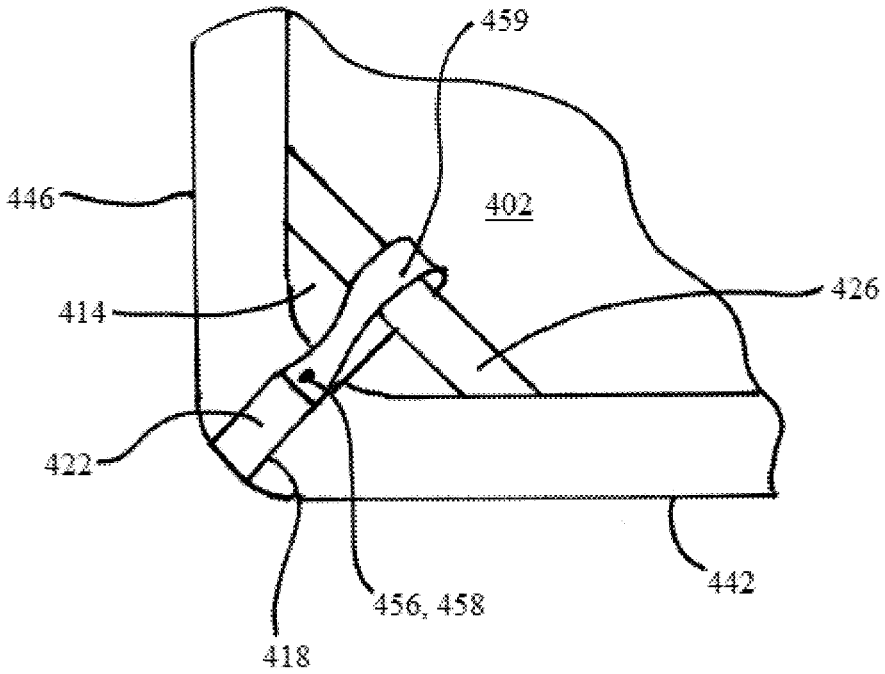
FIG. 24 is a detailed view of FIG. 23.
Figure 29:
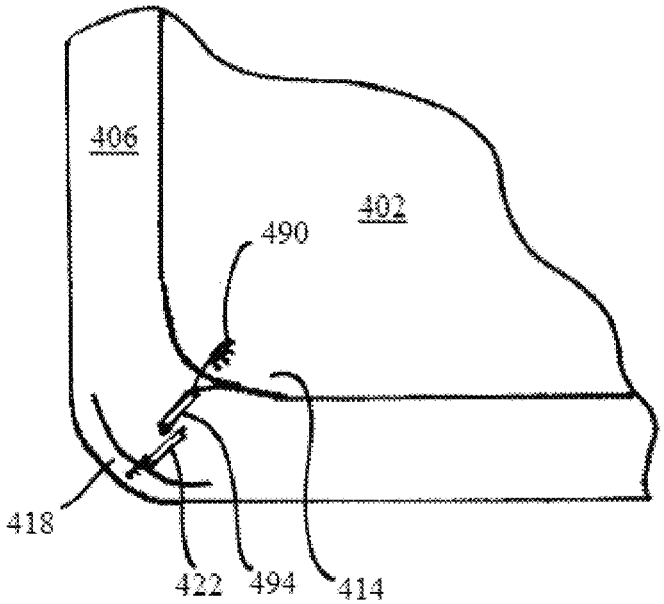
FIG. 29 is a detailed view of FIG. 23 showing an alternate technique for interconnecting a corner of the duvet to the duvet cover.

Methods of securing duvet corners to the interior corners of the duvet cover are shown in FIGS. 243-29. In FIG. 24, a strap 422 connected to the interior corner 418 of the duvet cover 406 is modified to include a snap base 456 and a snap top 458, wherein the strap 422 can be looped 459 and secured to itself. The loop 459 is configured to capture and anchor 426 employed on the duvet 402. One of ordinary skill in the art will appreciate that other selective interconnection mechanisms may be employed on the strap without departing from the scope of the present invention, such as hook and loop fasteners (e.g., Velcro™), magnets, rubber studs, a butterfly clutch, a jewelry clutch, a safety clasp, a screw/nut interconnection system, a stick pin, and any other similar type of selective interconnection mechanism or device. In other embodiments, the strap 422 extending from the interior corner of the duvet cover 418 may include a button, snap, magnet, hook and loop fastener, etc. that interconnects with a compatible connector sewn to the corner of the duvet. Alternatively, the corners of the duvet may include protrusions or buttons (in one embodiment, soft compliant buttons as found on rugby shirts, for example) that are received within holes provided in the straps 422 extending from the interior corners of the duvet cover.

Figure 25:
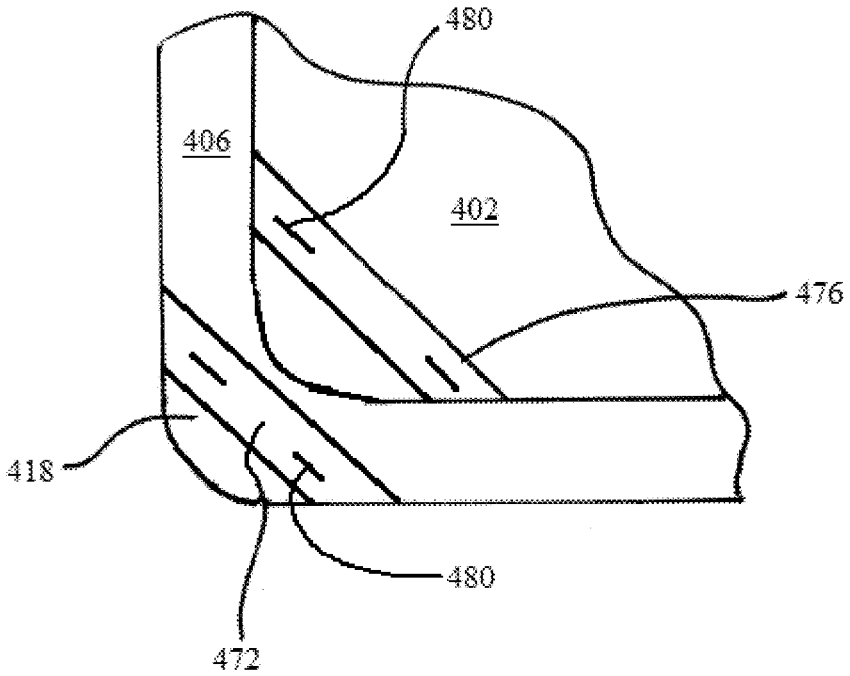
FIG. 25 is a detailed view of FIG. 23 showing an alternate technique for interconnecting a corner of the duvet to the duvet cover.
Figure 26:
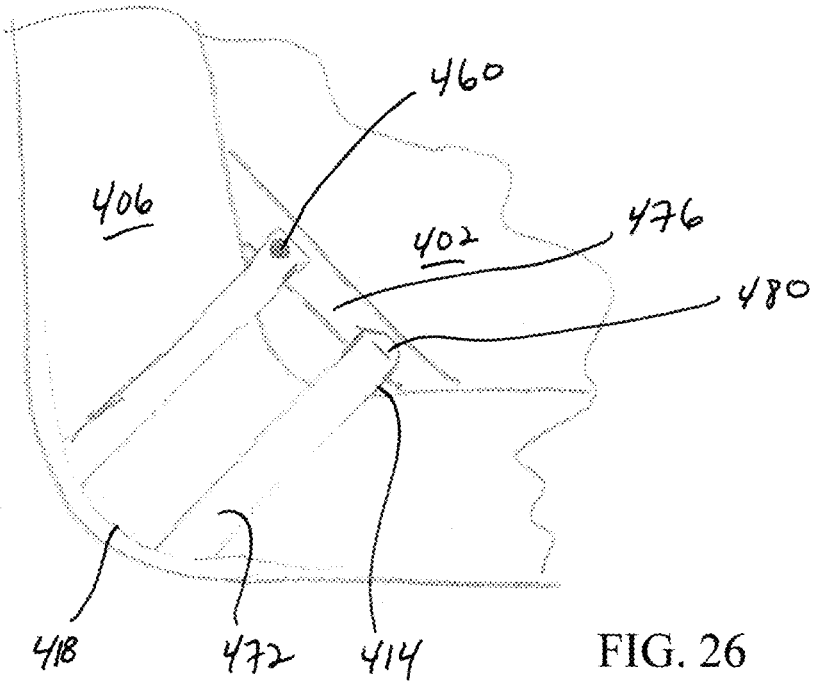
FIG. 26 is a detailed view of FIG. 23 showing an alternate technique for interconnecting a corner of the duvet to the duvet cover.
Figure 27:
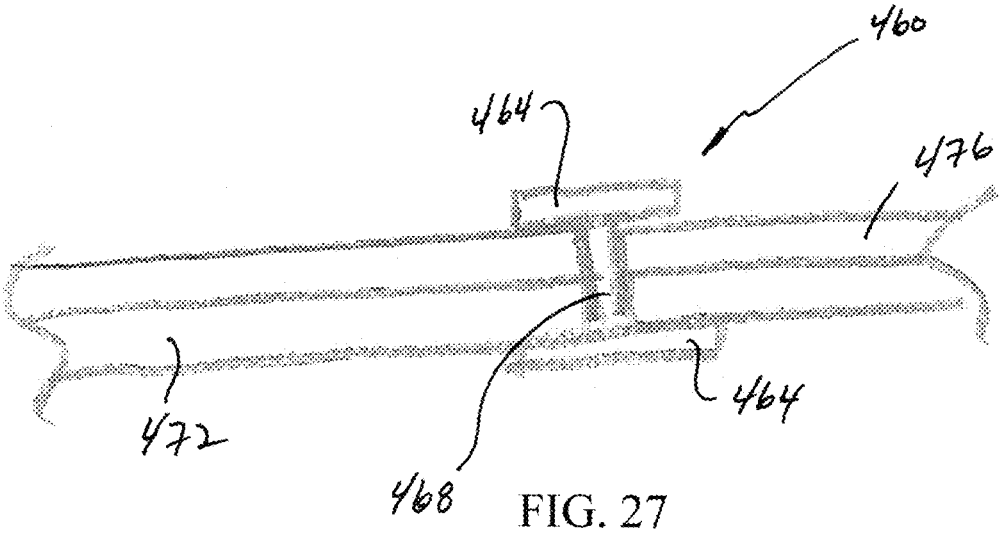
FIG. 27 is a detailed view of the interconnection scheme employed by the embodiments shown in FIGS. 25 and 26.

FIGS. 25-27 show a method employed by some embodiments of the present invention wherein the corner of duvet cover 418 interconnects with the corner of the duvet 414 by way of a connector 460 comprised of spaced buttons 464 interconnected by a member 468 as shown in FIG. 27. The member 468 may be rigid such as in the construction of a cufflink or bendable. In one embodiment of the present invention, the member 468 is made of an elastic material such that the spaced buttons 464 are biased towards each other.

FIG. 25 shows duvet cover with a strap 472 that engages a corresponding strap 476 on the duvet. FIG. 26 shows a related configuration wherein the duvet cover includes a plurality of straps 472 that engage a complimentary strap 476 on the duvet. One of ordinary skill in the art will appreciate that straps that extend from the corner of the duvet may be provided wherein the duvet cover includes a single strap, e.g., a configuration opposite to that shown in FIG. 26. In addition, it should be understood that the duvet and the duvet cover each may include straps extending outwardly from their respective corners without departing from the scope of the invention. Regardless of the configuration provided, each strap 472 and 476 are provided with holes or slots 480 configured to receive a connector 460 with a portion located within a space defined by coinciding strap holes and the thickness of the interconnected straps.

In one embodiment, the button 464 defined the extent of the member 468, wherein the interconnection between the member 468 and at least one of the buttons 464 is selectively modifiable such that moving the connector 460 through the aligned slots 480 of the interconnected straps 472 and 476 facilitated. For example, at least one button 464 may be made of a resilient material, such as rubber and deflectable, wherein the connector 460 can be pushed through aligned slots 480. In still yet other embodiments of the present invention, the member comprises a rigid post that receives a button 464 similar to the mechanisms found in lapel pins. The member 468 may be threaded wherein at least one button 464 is screwed onto the member 468 after it is threaded pushed the aligned slots 480.

Figure 28:
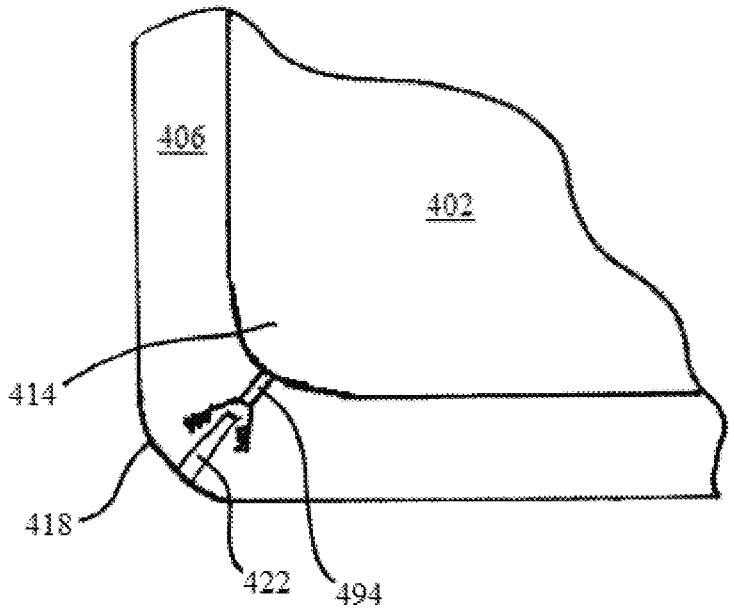
FIG. 28 is a detailed view of FIG. 23 showing an alternate technique for interconnecting a corner of the duvet to the duvet cover.

In some instances, the duvet does not include an anchor or strap emanating therefrom. Accordingly, a strap is provided that is interconnected to the corner of the duvet cover that terminates in a clip 490 that grasps a corresponding corner of the duvet. FIG. 28 shows a related embodiment wherein the clip 490 is interconnected to a strap 494 or anchor extending from the corner of the duvet 414 that selectively interconnects to the strap 422 extending from the interior corner 418 of the duvet cover 6.

Another embodiment is shown in FIG. 29 wherein clips 490 are used to grasp corners of the duvet 414 and corresponding interior corners of the duvet cover 418. The clips 490 can be directly interconnected with a buckle connection similar to that found on backpacks. Alternatively, the clips 490 may possess straps 422 and 494 extending therefrom adapted to selectively interconnect by any of the methods described herein or known in the art or knotted to each other. Still further, a single strap may extend between the clips.

Figure 30:
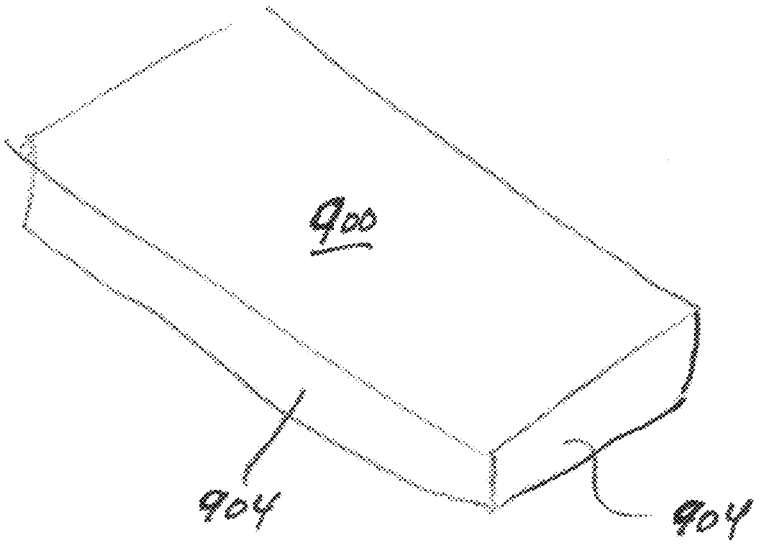
FIG. 30 is a perspective view of a sheet system of one embodiment of the present invention.
Figure 31:
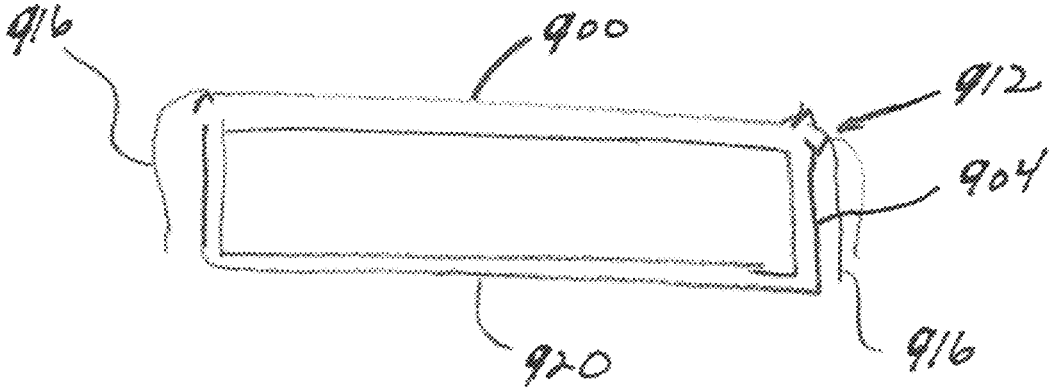
FIG. 31 is a cross-sectional view of FIG. 30.

FIGS. 30 and 31 show sheet system of one embodiment of the present invention that addresses some issues encountered in hospitals and hotels. U.S. Pat. No. 10,368,654 describes a bedding system that includes a removable top sheet 900 selectively interconnected to side members 904 that fit around lateral edges of a mattress 908. The '654 Patent also describes how the top sheet 900 is selectively interconnected to the side members 904 by way of a zipper 912, for example, and describes extensions interconnected to outer edges of the top sheet that will effectively conceal the side members. Thus, hospitality staff and medical personnel would not need to lift the mattress to remove the top sheet. The extensions are primarily provided to conceal the zipper, but they also function to conceal the side members.

In one embodiment, the side panels are constructed of a different material than that of the top sheet. For example, the side panels may be made of any fabric/mess/stretchable material. The extensions 918, which in this embodiment is of the same material as the top sheet and has a free, draping edge, hide the side panels. Furthermore, the side members 904 can be made of an antibacterial or an easy-to-clean material (e.g., plastic) that can be quickly sanitized between guests or patients, but which may not be aesthetically pleasing. The extensions 918 address this issue by concealing the side members 904. In some embodiments, the extensions 416 are configured to selectively interconnect to the side members 904 by any of the mechanisms or means described herein.

The side members form a stable sheet base configured to fit snugly on the mattress. The corners formed by interconnected base members may be comprised of vertical elastic material that allows the base to accommodate a variety of mattress thicknesses. The bottom edges of the side members employ continuous and sturdy elastic edges that extend well underneath the mattress to enhance interconnection thereto. Some embodiments, however, employ a bottom member 920 or straps that interconnect longitudinal or transverse bottom edges of the side members under the mattress. In some embodiments of the present invention, the top sheet includes a pocket for air mattresses, disposable pads, etc. which help keep these components in place and enhance patient comfort.

Figure 32:
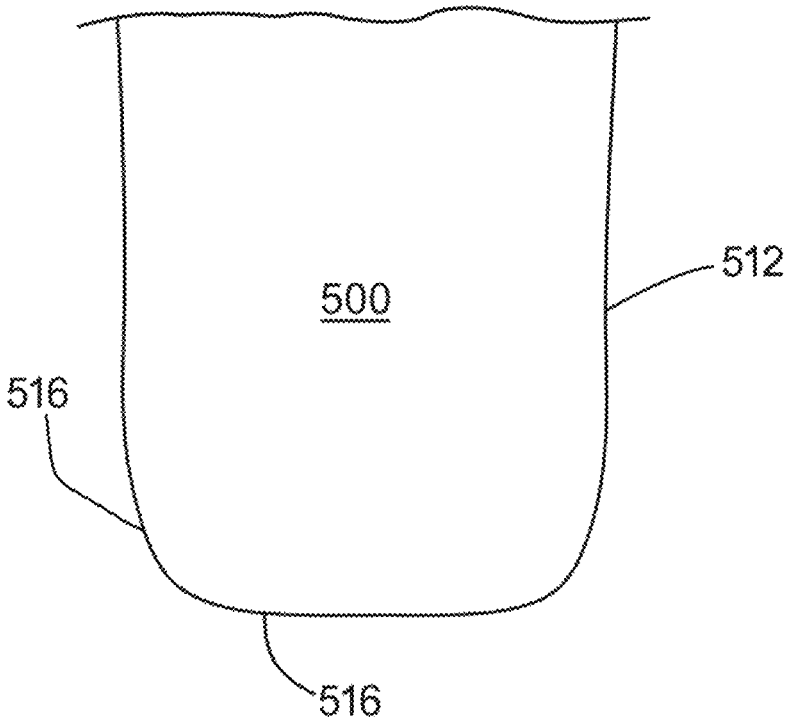
FIG. 32 is a top plan view of a bed sheet system of another embodiment of the present invention.
Figure 33:
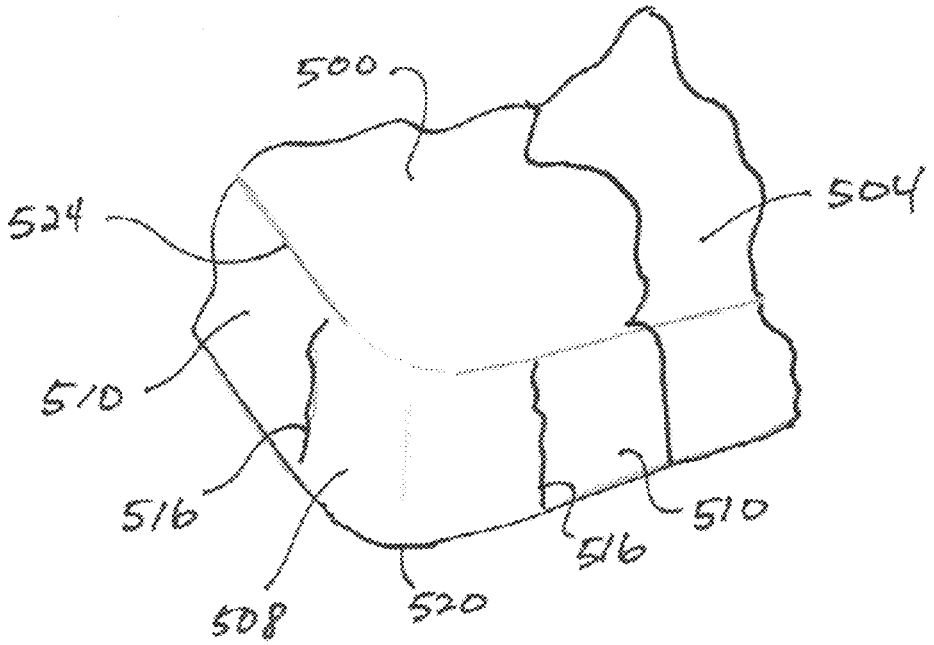
FIG. 33 is a detailed view of FIG. 32 showing a corner of a bed and interconnected sheet.

FIGS. 32 and 33 show a sheet 500 of another embodiment of the present invention that provides a secure connection with a mattress 504. More specifically, some mattresses are not of traditional construction, wherein their corners employ a curve, which adversely affects the fit of the sheet onto the mattress. Here, the sheet has an elongated corner member 508 configured to correspond with curved mattress corners. Side panels 510 interconnected to the curved mattress corners are interconnected to a top edge to 512 of the sheet 500. The side panels 510 may employ an elastic bottom edge that fits beneath the mattress to securely hold the sheet onto the mattress. In traditional construction, the side panels meet at a rough corner secured by at least one seam that does not accommodate curved mattress corners very well.

The corner member 508 replaces the traditional sheet corner construction and includes ends comprise of elastic members 516. In some embodiments, the present invention employs elastic members between the two and elastic members 516 to further enhance fit. In still yet other embodiments, the entirety of the corner member 508 is made of an elastic material or flexible fabric. The bottom edge 520 of the corner member 508 may also be elastic to correspond with elastic edges of the side members 510. As one of ordinary skill in the art will appreciate, the sheet 500 may be selectively interconnected to a top edge 524 of the side panel 510 and corner members 508 as described in the applications and patents listed above and incorporated by reference herein.

Figure 33A:
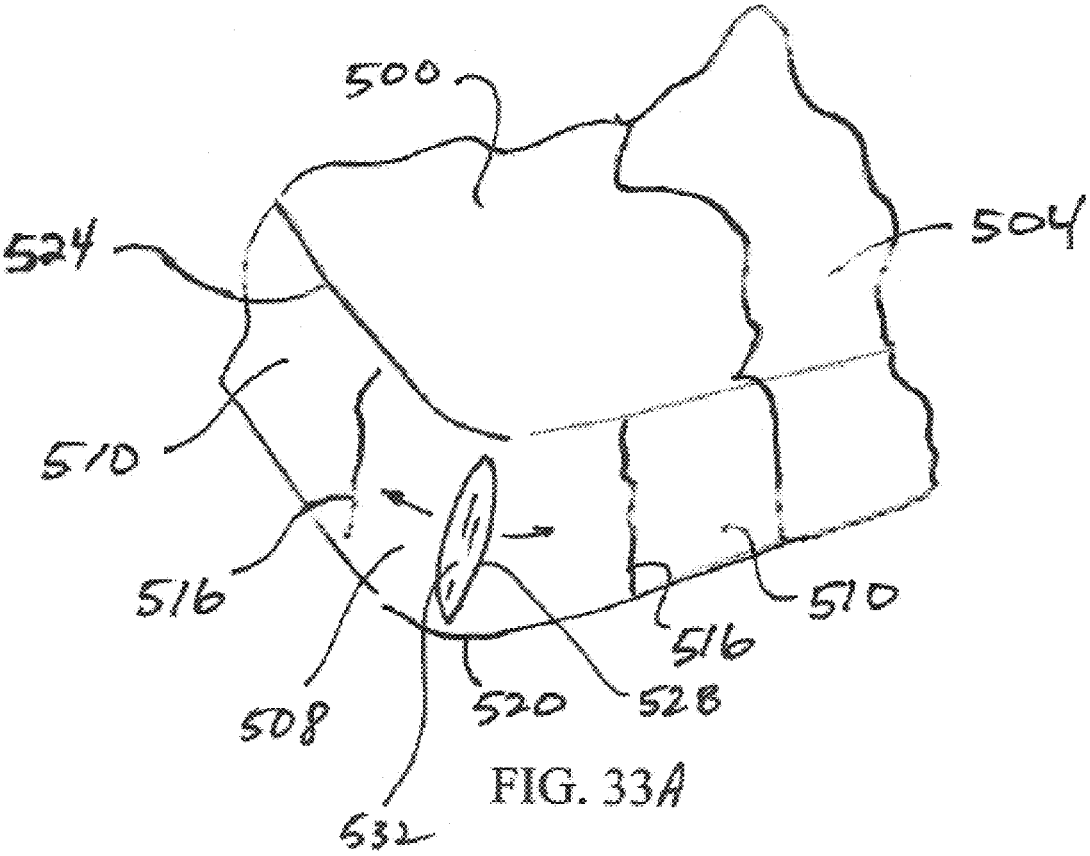
FIG. 33A is a detailed view of FIG. 32 showing a corner of a bed and interconnected sheet of another embodiment of the present invention.

In the embodiment shown in FIG. 33A, the corner member 508 includes an opening 528 or slit extending from the top edge 524 or a point adjacent to the top edge 524 to the bottom edge 520 or to a point adjacent to the bottom edge 520. The opening 528 is associated with additional corner member fabric 532 that may be flexible. The opening 528 may be selectively closable to conceal the fabric 532. For example, the opening may be selectively closed with a zipper, laces, buttons, snaps, etc. In operation, separating the opening's edges allows the fabric 532 to expand to receive thicker and/or larger mattresses.

Figure 34:
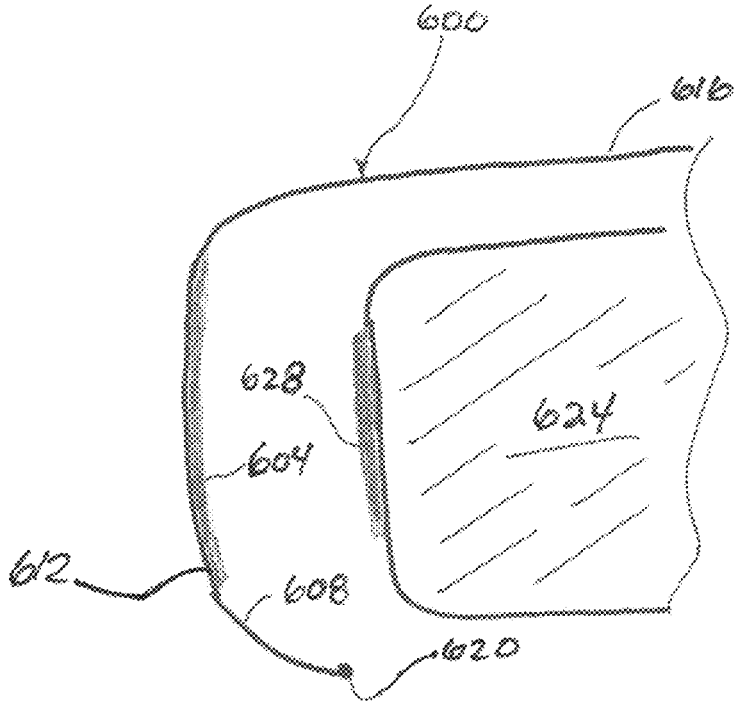
FIG. 34 is a partial cross-section showing a bed sheet system of another embodiment of the present invention.
Figure 35:
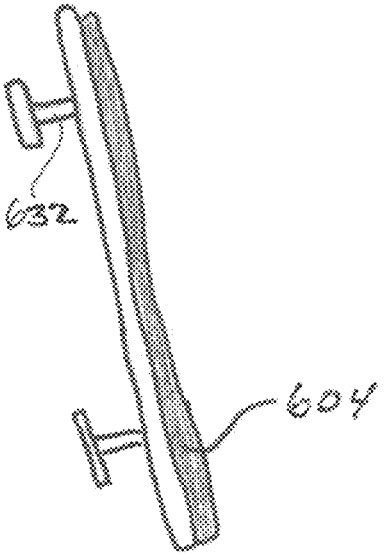
FIG. 35 is a side elevation view of a gripping member employed by some embodiments of the present invention.
Figure 36:
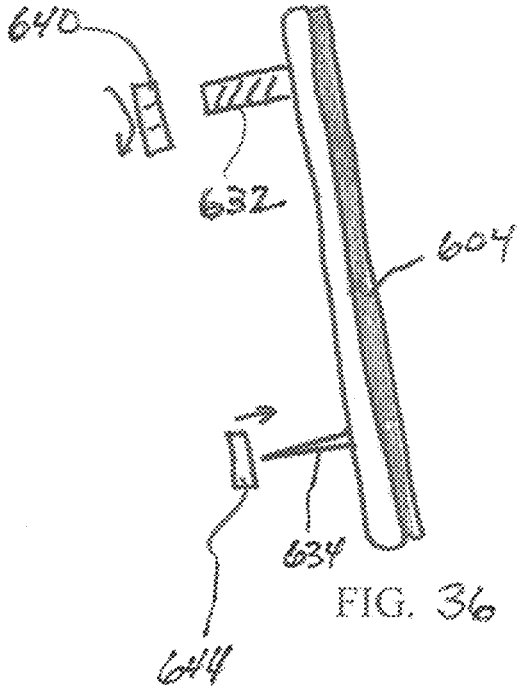
FIG. 36 is a side elevation view of a gripping member employed by some embodiments of the present invention.

FIGS. 34-36 shows a sheet 600 of another embodiment of the present invention that employs at least one gripping member 604 associated with its inner surface 608. Here, the gripping member 604 is associated with the inner surface 608 of the sheet's side panel 612. In other embodiments, the gripping member 604 is associated with the top panel 616 of the sheet 600. Of course, gripping members 604 may be associated with the mattress's side panels 612, corners, and/or and top panel 616. The gripping member 604 may be provided in the form of a thin strip or possess a wider dimension to cover more of the mattress. The gripping member of one embodiment of the present invention is made of a silicone or rubber-based material. In other embodiments, the "gripping member" is comprised of a magnet that selectively engages a magnet provided on the mattress 624, or corresponding hook and loop interconnection members. The side panel 612 may also possess an elastic edge 620 at its bottom end to enhance sheet contact with the mattress. In addition, one of ordinary skill in the art will appreciate that the side panel 612 may be selectively interconnected to the top panel 616 by way of a zipper, for example.

In operation, the gripping members 604 engage the mattress 624, thereby reducing or preventing movement of the sheet 600 relative to the mattress 624. This functionality is desirable, especially when the sheet 600 is employed on a selectively movable mattress 624, which will be described below. In some other embodiments, a gripping member 628 is also employed on the mattress. The gripping member 604 may be interconnected to the sheet 600 and/or mattress 624 with adhesive. In other embodiments, the gripping member is sewn onto the sheet 600. And still yet in other embodiments, the gripping member 604 is selectively interconnected to the sheet 600, which will be described in further detail below.

FIGS. 35 and 36 show examples of how the gripping members 604 of some embodiments are constructed. The gripping member 604 of FIG. 35 is associated with at least one post 632 that terminates at a button 636. As in some of the embodiments described above, the button 636 may be selectively deflectable, similar to a rugby shirt button, and configured to fit through a corresponding hole or slot provided in the sheet. Accordingly, this embodiment of the present invention is selectively removable from the sheet, which facilitates sheet cleaning and folding. FIG. 36 shows a similar embodiment where the gripping member is associated with posts 632 of a different character. For example, the posts 632 may be threaded and configured to accept a nut 640 or similar fastener, wherein posts are fit through holes in the sheet and the sheet is positioned between the nut and the gripping member. Alternatively, the post may be relatively smooth with a pointed tip and configured to accept a backing member 644, such as those found on lapel pins.

Figure 37:
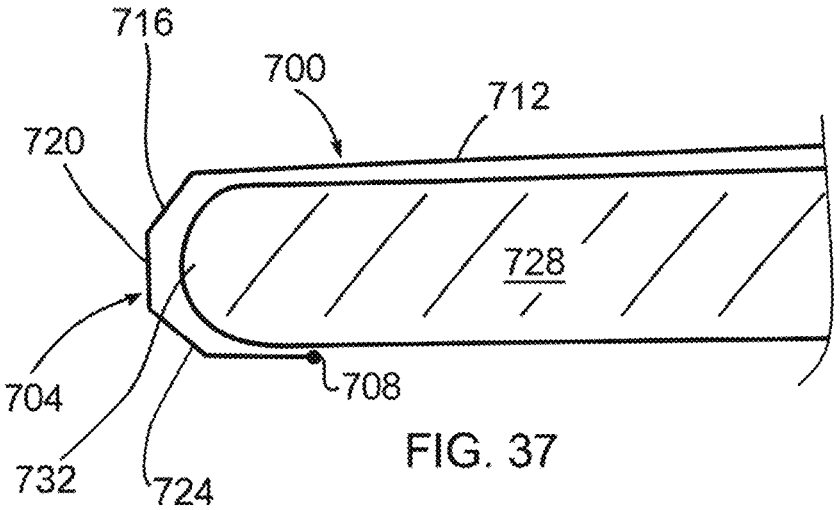
FIG. 37 is a partial cross-section showing a bed sheet system of another embodiment of the present invention.
Figure 38:
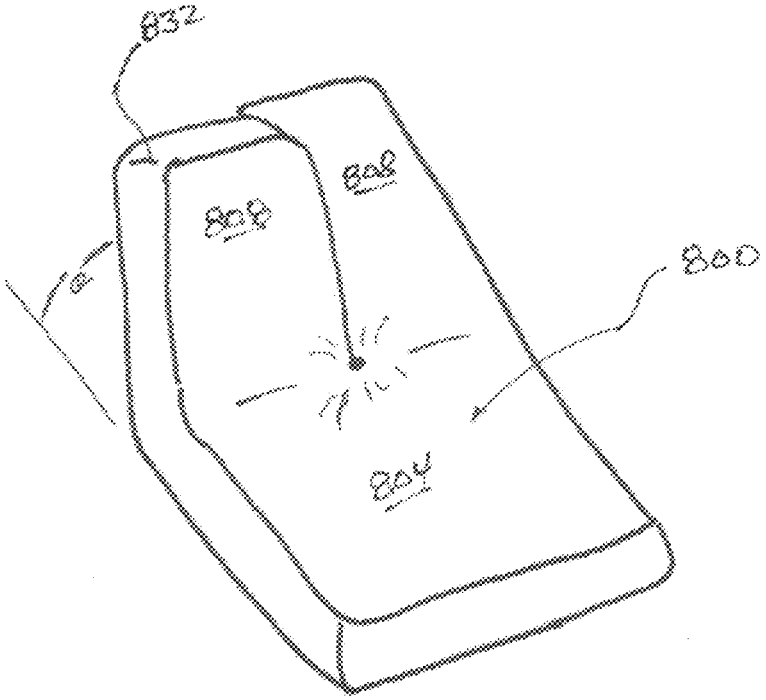
FIG. 38 is a perspective view showing a bed sheet system of another embodiment of the present invention configured to accommodate split mattress beds.
Figure 39:
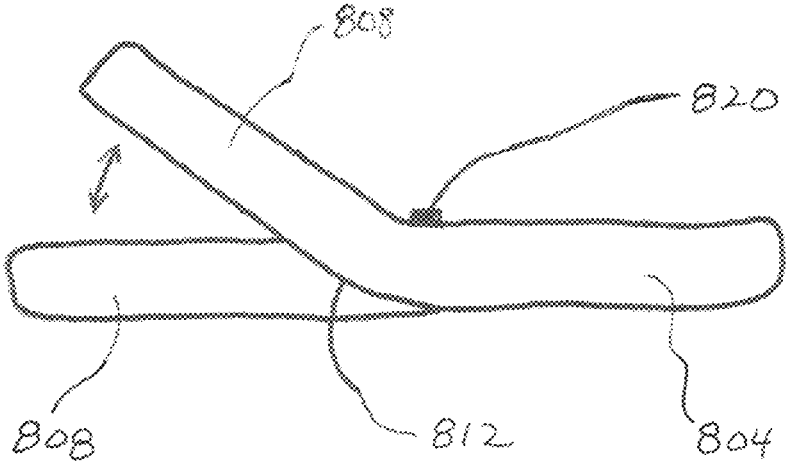
FIG. 39 is a side elevation view of FIG. 38.
Figure 40:
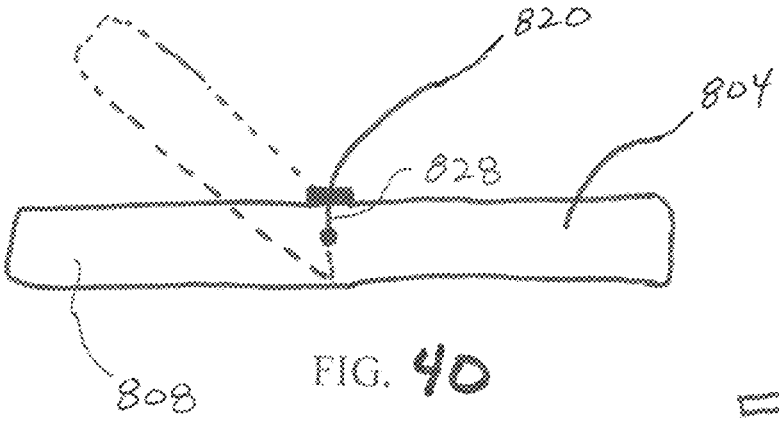
FIG. 40 is a side elevation view of FIG. 38, wherein a portion of the mattress is omitted for clarity.
Figure 41:
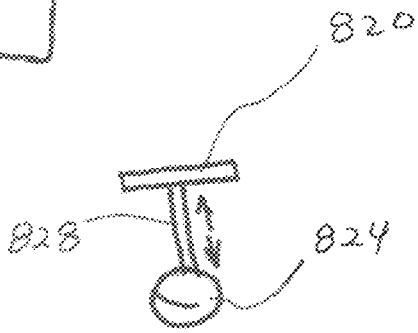
FIG. 41 shows an anchor member employed by the embodiment of the present invention shown in FIG. 38.

FIG. 37 shows a sheet 700 of yet another embodiment of the present invention that employs a multifaceted side panel 704. Like some of the other embodiments described herein, the side panel may terminate at an clastic end 708 and/or be selectively interconnected to the top panel 712. Here, the side panel 704 comprises an angled upper segment 716, a primary segment 720, and an angled lower segment 724. Those of ordinary skill in the art will appreciate that the side panel 704 may have more facets. The sheet 700 of this embodiment is configured to facilitate interconnection with the mattress 728 that employs a rounded edge profile 732 found in many dorm and RV mattresses. The features of other mattresses described above-elastic corner members (FIG. 33) and gripping members (FIG. 34)—may be included with this embodiment.

Figure 42:
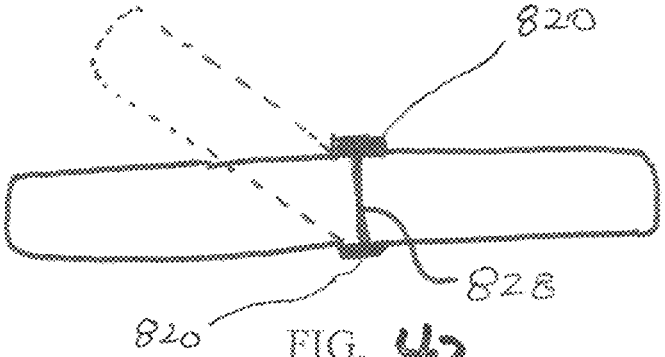
FIG. 42 is a side elevation view of FIG. 38, wherein a portion of the mattress is omitted for clarity.

FIGS. 38-42 show a sheet 800 of still yet another embodiment of the present invention adapted to fit onto half-split mattresses defined by a foot portion 804 with movable head portions 808 extending therefrom. The head portions 808 define a split plane 812 that extends from the head of the mattress towards the foot of the mattress. It is often difficult to securely maintain a sheet onto these types of mattresses because head portions 808 can move relative to each other and relative to the foot portion. Accordingly, an anchor 816 is provided that interfaces with the split plane 812 at a point where the head portions 808 meet the foot portion 804. The anchor 816 includes a sheet retention member 820 interconnected to a stay 824 by way of an elastic member 828. In one embodiment of the present invention shown in FIGS. 40 and 41, the stay is interference fit within the split plane. The sheet retention member 820 engages the top panel of the foot portion 804 and is biased towards the stay 804 by the elastic member 828, thereby anchoring in the sheet 800 to the mattress. Fixing this portion of the sheet 800 helps prevent motion of the sheet relative to the mattress, especially at the corners 832 of the head portions 808 as they move relative to the foot portion 804. FIG. 42 shows an alternative embodiment of the anchor 816 that employs retention members 820 on either side of the elastic number 828. Here, one retention member is configured to interface with the top panel of the sheet 800 and the opposite retention member is designed to interface with the bottom of the mattress.

The term "mattress," as used herein, refers to mattresses of all sizes and thicknesses. Accordingly, the mattress may be sized for a crib or a toddler's bed. The mattress may also be for a fold-out bed (such as a sofa sleeper, a cot, or a murphy bed). Alternatively, the mattress may be one of a twin, full, queen, king, or any other size mattress. The sheets described herein may also be sized to fit an inflatable mattress of any size or shape.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. It should also be understood that the aspects of various embodiments described herein may be combined and/or combined with the inventions and aspects of inventions described and claimed in the applications for patent and patents referred to above and incorporated by reference herein. For example, aspects of the inventions disclosed in U.S. Pat. Nos. 3,570,026, 3,591,875, 4,922,565, 5,042,099, 6,757,923, 7,231,679, 7,487,561, 7,975,334, 8,332,976, 8,726,907, U.S. Pat. App. Pub. No. 20030177579, U.S. Pat. App. Pub. No. 20040139552, U.S. Pat. App. Pub. No. 20070113341, U.S. Pat. App. Pub. No. 20070174962, and U.S. Pat. App. Pub. No. 20150182032, all of which are incorporated by reference herein, may be incorporated into embodiments of the present invention.

What is claimed is:

1. A bed sheet system adapted for selective interconnection to a mattress consisting of a head portion, a foot portion, a top surface, a lower surface, and a sidewall separating the top surface from the lower surface, the bed sheet system, comprising:

a top portion adapted to interface with an upper surface of the mattress having a first edge, a second edge spaced from the first edge, a left lateral edge interconnected to the first edge with a first corner edge and to the second edge with a second corner edge, and a right lateral edge interconnected to the first edge with a third corner edge and to the second edge with a fourth corner edge;

a first side panel having an upper edge interconnected to the first edge of the top portion, a lower edge, and lateral edges that interconnect ends of the upper edge to ends of the lower edge;

a second side panel having an upper edge interconnected to the second edge of the top portion, a lower edge, and lateral edges that interconnect ends of the upper edge to ends of the lower edge;

a left lateral side panel having an upper edge interconnected to the left lateral edge, a lower edge, and lateral edges that interconnect ends of the upper edge to ends of the lower edge;

a right lateral side panel having an upper edge interconnected to the right lateral edge, a lower edge, and lateral edges that interconnect ends of the upper edge to ends of the lower edge; and a first corner member having an upper edge interconnected to the first corner edge, a lower edge, and lateral edges that interconnect corresponding lateral edges of the first side panel and the left lateral side panel;

a second corner member having an upper edge interconnected to the second corner edge, a lower edge, and lateral edges that interconnect corresponding lateral edges of the left lateral side panel and the second side panel;

a third corner member having an upper edge interconnected to the third corner edge, a lower edge, and lateral edges that interconnect corresponding lateral edges of the first side panel and the right lateral side panel;

a fourth corner member having an upper edge interconnected to the fourth corner edge, a lower edge, and lateral edges that interconnect corresponding lateral edges of the right lateral side panel and the second side panel; and wherein at least one of the first, second, third, and fourth corner member includes an opening associated with a fabric member configured to expand when the opening is expanded.

2. The system of claim 1, wherein a portion of the corner members are made of an elastic material.

3. The system of claim 1, wherein the lateral edges of the first, second, third, and fourth corner member are at least partially comprised of an elastic material.

4. The system of claim 1, wherein a portion of the fabric member is flexible.

5. The system of claim 1, wherein the opening has edges that are selectively interconnected.

6. The system of claim 1, wherein the opening has edges that are selectively interconnected with a zipper, laces, at least one snap, or at least one button.

7. The system of claim 1, wherein the upper edges of the corner members have a curved profile.

8. The system of claim 1, wherein the upper edges of the corner members are curved with a radius of curvature of about 18 inches.

9. The system of claim 1, further comprising a gripping member interconnected to an inner surface of the corner members.

10. The system of claim 1, wherein the fabric member further includes an elastic seam located between lateral edges thereof.

11. The system of claim 1, wherein at least a portion of the lower edges of the first side panel, the second side panel, the left lateral side panel, right side panel, and corner members are comprised of an elastic material.

12. The system of claim 1, further comprising a lower portion having an edge that interconnects to the lower edges of the first side panel, the second side panel, the left lateral side panel, right lateral side panel, and corner members.

13. The system of claim 12, wherein the top portion is removable and selectively attached to the upper edges of the first side panel, the second side panel, the left lateral side panel, right lateral side panel, and corner members, wherein the top portion is selectively attached to the first side panel, the second side panel, the left lateral side panel, right lateral side panel, and corner members with a zipper, a plurality of snaps, a zip lock mechanism, or buttons.

14. The system of claim 1, wherein the fabric member further includes an elastic seam located between lateral edges thereof, and wherein at least a portion of the lower edges of the first side panel, the second side panel, the left lateral side panel, right side panel, and corner members are comprised of an elastic material.

15. A bed sheet system adapted for selective interconnection to a half-split mattress consisting of a left head portion, a right head portion, a foot portion, a top surface, a lower surface, a sidewall separating the top surface from the lower surface, a left interior sidewall, a right interior sidewall, the bed sheet system, comprising:

a top portion defined by a primary segment associated with the foot portion of the mattress, a left segment extending from the primary segment and associated with the left head portion, and a right segment extending from the primary segment and associated with the right head portion, the left segment and right segment configured to fold independently relative to the primary segment, and the top portion further comprising:

a first left edge, a first right edge, a second edge spaced from the first left edge and first right edge, a left lateral edge interconnected to the first left edge by a first corner edge and to the second edge by a second corner edge, a right lateral edge interconnected to the first right edge by a third corner edge and to the second edge by a fourth corner edge, an interior left lateral edge interconnected to the first left edge by a fifth corner edge; and an interior right lateral edge interconnected to the first right edge by a sixth corner edge;

a first left side panel having an upper edge interconnected to the first left edge of the top portion, a lower edge configured to engage the sidewall or the lower surface of the mattress, and lateral edges that interconnect ends of the upper edge to ends of the lower edge;

a first right side panel having an upper edge interconnected to the first right edge of the top portion, a lower edge configured to engage the sidewall or the lower surface of the mattress, and lateral edges that interconnect ends of the upper edge to ends of the lower edge;

a second side panel having an upper edge interconnected to the second edge of the top portion, a lower edge to engage the sidewall or the lower surface of the mattress, and lateral edges that interconnect ends of the upper edge to ends of the lower edge;

a left lateral side panel having an upper edge interconnected to the left lateral edge, a lower edge, and lateral edges that interconnect ends of the upper edge to ends of the lower edge;

a right lateral side panel having an upper edge interconnected to the right lateral edge, a lower edge, and lateral edges that interconnect ends of the upper edge to ends of the lower edge; and an interior left lateral side panel having an upper edge interconnected to the interior left lateral edge, a lower edge, and lateral edges that interconnect ends of the upper edge to ends of the lower edge;

an interior right lateral side panel having an upper edge interconnected to the interior right lateral edge, a lower edge, and lateral edges that interconnect ends of the upper edge to ends of the lower edge;

a first corner member having an upper edge interconnected to the first corner edge, a lower edge, and lateral edges that interconnect corresponding lateral edges of the first left side panel and the left lateral side panel;

a second corner member having an upper edge interconnected to the second corner edge, a lower edge, and lateral edges that interconnect corresponding lateral edges of the left lateral side panel and the second side panel;

a third corner member having an upper edge interconnected to the third corner edge, a lower edge, and lateral edges that interconnect corresponding lateral edges of the first right side panel and the right lateral side panel;

a fourth corner member having an upper edge interconnected to the fourth corner edge, a lower edge, and lateral edges that interconnect corresponding lateral edges of the right lateral side panel and the second side panel;

a fifth corner member having an upper edge interconnected to the fifth corner edge, a lower edge, and a lateral edge, which is opposite from the first corner member, interconnected to a corresponding lateral edge of the first left side panel;

a sixth corner member having an upper edge interconnected to the sixth corner edge, a lower edge, and a lateral edge, which is opposite from the third corner member, interconnected to a corresponding lateral edge of the first right side panel; and wherein at least one of the first, second, third, fourth, fifth, or sixth corner member includes an opening associated that accommodates a fabric member configured to expand when edges of the opening are moved apart.

16. The system of claim 15, wherein at least a portion of the corner members are made of an elastic material.

17. The system of claim 15, wherein the lateral edges of the first, second, third, fourth, fifth, and sixth corner member are at least partially comprised of an elastic material.

18. The system of claim 15, wherein a portion of the fabric member is flexible.

19. The system of claim 15, wherein the opening has edges that are selectively interconnected with a zipper, laces, at least one snap, or at least one button.

20. A bed sheet system, comprising:

a top portion having a first edge configured to interface with a head portion of a mattress, a second edge spaced from the first edge and configured to interface with a foot portion of the mattress, and a left lateral edge and a right lateral edge that associate the first edge to the second edge;

a first side panel having an angled upper segment with an upper edge interconnected to the first edge of the top portion, an intermediate segment interconnected to the upper segment, and an angled lower segment with a lower edge configured to engage a sidewall or a lower surface of the mattress, and lateral edges that interconnect ends of the upper edge to ends of the lower edge;

a second side panel having an angled upper segment with an upper edge interconnected to the second edge of the top portion, an intermediate segment interconnected to the upper segment, and an angled lower segment with a lower edge configured to engage a sidewall or the lower surface of the mattress, and lateral edges that interconnect ends of the upper edge to ends of the lower edge;

a left lateral side panel having an angled upper segment with an upper edge interconnected to the left lateral edge, an intermediate segment interconnected to the upper segment, and an angled lower segment with, a lower edge configured to engage a sidewall or the lower surface of the mattress, and lateral edges that interconnect ends of the upper edge to ends of the lower edge;

a right lateral side panel having an angled upper segment with an upper edge interconnected to the right lateral edge, an intermediate segment interconnected to the upper segment, and an angled lower segment with a lower edge configured to engage a sidewall or the lower surface of the mattress, and lateral edges that interconnect ends of the upper edge to ends of the lower edge; and a first corner member having an upper edge interconnected to a first corner edge of the top portion, a lower edge, and lateral edges that interconnect corresponding lateral edges of the first side panel and the left lateral side panel;

a second corner member having an upper edge interconnected to a second corner edge of the top portion, a lower edge, and lateral edges that interconnect corresponding lateral edges of the first side panel and the right lateral side panel;

a third corner member having an upper edge interconnected to a third corner edge of the top portion, a lower edge, and lateral edges that interconnect corresponding lateral edges of the right lateral side panel and the second side panel;

a fourth corner member having an upper edge interconnected to a fourth corner edge of the top portion, a lower edge, and lateral edges that interconnect corresponding lateral edges of the left lateral side panel and the second side panel; and wherein at least one of the first, second, third, and fourth corner member includes an opening associated with a fabric member configured to expand when edges of the opening are separated.

* * * * *